US006360068B1

(12) United States Patent
Kinoshita et al.

(10) Patent No.: US 6,360,068 B1
(45) Date of Patent: Mar. 19, 2002

(54) ELECTROPHOTOGRAPHIC IMAGE FORMATION PROCESS AND APPARATUS

(75) Inventors: Masakazu Kinoshita, Kato; Takashi Yamamoto, Kawasaki; Masae Nakamura; Yoshimichi Katagiri, both of Kawasaki; Shin-ichi Kuramoto, Numazu; Hachiro Tosaka, Shizuoka; Hiroshi Yamashita, Numazu; Osamu Uchinokura, Shizuoka; Kazuhiko Hamazoe, Kato, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/667,717

(22) Filed: Sep. 22, 2000

(30) Foreign Application Priority Data

Nov. 19, 1999 (JP) ..... 11-330215
Nov. 19, 1999 (JP) ..... 11-330440

(51) Int. Cl.[7] ..... G03G 15/08
(52) U.S. Cl. ..... 399/284; 399/286
(58) Field of Search ..... 399/274, 284, 399/286; 430/105, 107, 106, 109, 137

(56) References Cited

U.S. PATENT DOCUMENTS 5,412,458 A * 5/1995 Kamaji et al. ..... 399/284 X
6,021,299 A * 2/2000 Hansburg et al. ..... 399/284
6,187,495 B1 * 2/2001 Chiba et al. ..... 430/106

* cited by examiner

*Primary Examiner*—Sophia S. Chen
*Assistant Examiner*—Hoan Tran
(74) *Attorney, Agent, or Firm*—Armstrong, Westerman & Hattori, LLP

(57) ABSTRACT

In a method for forming a color image by using a contact type nonmagnetic one-component developing device, a flat sheet-like blade made of a metal flexible member and having a distal end thereof chamfered is used inside the developing device in combination with a toner having a glass transition point of 55 to 70° C. and a weight average particle diameter of 6.0 to 10.0 μm, and containing up to 20 number % of particles having particle diameters of 5 μm or below, as a developer. The developing device is simple in construction, can provide high image quality and can, moreover, provide a highly reliable image formation method.

24 Claims, 16 Drawing Sheets

ELECTROPHOTOGRAPHIC IMAGE FORMATION PROCESS AND APPARATUS

BACKGROUND OF THE INVENTION

1. Field of the Invention

This invention relates to an electrophotographic image formation process and an apparatus for this process. More particularly, this invention relates to a color image formation process that restricts the thickness of a developer layer on a developing roller by the use of a toner layer thickness-limiting blade having a specific structure and visualizes an electrostatic latent image formed on an image support by the use of a nonmagnetic one-component developer, for example, and to an apparatus for this process. The present invention relates further to an image formation apparatus employing an electrophotographic process that uses a specific developer support and a developer feeding member in combination with a specific one-component developer.

2. Description of the Related Art

Electrophotographic image formation apparatuses such as laser printers have gained a wide application for output terminal devices of computers, facsimiles, copying machines, and so forth, with the progress of office automation. An image formation apparatus of this kind includes generally a charging device for electrically and uniformly charging a photosensitive drum as an image support, an exposing device for forming an electrostatic image on the photosensitive drum by the irradiation of light, a developing device for developing the electrostatic image on the photosensitive drum and making it visible by using a developer (toner), an image transferring device for transferring the toner image formed on the photosensitive drum by development to a recording medium such as a recording sheet, and an image fixing device for fusing the toner image so transferred to the recording medium and fixing the image to the medium.

The developing device generally comprises a developing roll so disposed as to oppose, and to come into contact with, the photosensitive drum, a toner container for storing the toner, a toner supplementing device for feeding the toner to the developing roll and a toner layer thickness-limiting blade for controlling the thickness of the toner supplied onto the developing roll. As the toner is allowed to adhere electrically and uniformly from the toner layer on the developing roll to the electrostatic latent image on the photosensitive drum, development, that is, visualization, of the electrostatic latent image, can be conducted. To use again the used photosensitive drum after the toner image is transferred, a de-charging device for removing the charge from the surface of the photosensitive drum and a cleaning device for scraping off the residual toner is disposed round the photosensitive drum.

The developing device used for the image formation apparatus described above includes a device of the type designed to use a one-component developer comprising only the toner and a device of the type designed to use a two-component developer comprising the combination of the toner and a carrier. Since the one-component type developing device does not use a carrier, it need not take into consideration degradation of the carrier, mixing of the carrier with the toner and the mixing ratio, in particular. Therefore, the one-component type developing device has the advantages that the apparatus can be made compact in size and its production cost can be lowered. Furthermore, when the developer used is nonmagnetic, this developing device can form a high-quality color image because the toner has high transparency.

When a one-component developing device is used, a process step for charging compulsively the developer, imparting the charge to the developing roller and causing the toner to adhere to the developing roller is necessary unlike the two-component developing device, that uses the developer comprising the mixture of the carrier and the toner and lets it adhere to the magnet roller, because the one-component developer used does not have a carrier. Therefore, the one-component developer uses a toner having a relatively high volume resistivity. When a toner having a volume resistivity of $10^{10}$ Ωcm to $10^{13}$ Ωcm, or more, is used, a compulsive charging operation to a predetermined polarity is necessary. Therefore, a triboelectrical or frictional charging member for imparting triboelectrical charge to the toner is also provided to the developing device.

A blade for uniformly limiting the toner adhering to the developing roller to a predetermined thickness and a charging member used for imparting exclusively triboelectrical charge to the toner, for example, have been used as the triboelectrical charging member. Among them, the blade for limiting the toner to a predetermined thickness and at the same time, charging the toner, has the simplest structure and can reduce the cost. As will be understood from the following explanation, the toner layer thickness-limiting blade used inside the developing device in the embodiments of the present invention includes a blade that has the function of exclusively limiting the toner layer thickness, a blade having the exclusive function of frictional charging, and a blade having both of these functions.

FIGS. 1 to 5 schematically depict the developing devices equipped with the conventional toner layer thickness-limiting blades (partial views).

In the developing device shown in FIG. 1, a blade 50 made of a resin or a metal having a relatively high hardness and a thickness of 2 to 4 mm is fitted into a blade guide 51 in such a fashion as to be capable of moving in and out due to a coil spring 52. The blade 50 is brought into pressure contact with a developing roller 2, rotating in a direction indicated by an arrow B, at a constant pressure. The developing roller 2 can rotate while keeping contact with an image support (typically, a photosensitive drum) 1 that is so disposed as to oppose the developing roller 2 and to be capable of rotating in a direction indicated by an arrow A.

The developing device shown in FIG. 2 uses a blade 50 produced by shaping the distal end portion of a leaf spring into an L shape. In this device, one of the ends of the blade 50 is fixed to a blade holder 51 made of a material having high rigidity, and an L-shaped edge as the other end of the blade 50 is brought into pressure contact at a constant pressure with the developing roller 2 by its own flexibility.

In the developing device shown in FIG. 3, a blade 50 made of a flexible material such as a rubber is bonded to, and extended from, one of the ends of the blade holder 51, and the distal end portion of the blade 50 is brought into pressure contact with the developing roller 2.

The developing device shown in FIG. 4 uses a blade 50 formed by shaping the distal end portion of a leaf spring into a U-shaped. In this device, one of the ends of the blade 50 is fixed to a blade holder 51 made of a material having high rigidity, and a U-shaped surface as the other end of the blade 50 is brought into pressure contact with the developing roller 2 at a predetermined pressure by its own flexibility.

In the developing device shown in FIG. 5, one of the ends of a blade 50 comprising a leaf spring is fixed to a blade holder 51. The distal end of the blade is subjected to rounded edge machining to impart roundness (not shown). The edge portion having this roundness is brought into pressure contact with the developing roller 2 at a constant pressure.

However, the toner layer thickness-limiting blades used in the developing devices shown in FIGS. 1 to 5 involve respective problems to be solved. The toner layer thickness-limiting blade shown in FIG. 1, for example, involves the problems of distortion of the developing roller resulting from creep, the occurrence of horizontal stripes resulting from this distortion and the occurrence of "fog" resulting from non-uniformity of the toner layer thickness. The blade shown in FIG. 2 involves the problem of deterioration of the toner resulting from fine cracks at the L-shaped edge. The blade shown in FIG. 3 involves the problem of the drop of the frictional charging capacity resulting from creep. The blade shown in FIG. 4 involves the problem of fixation of the toner resulting from a limit to planarity. Furthermore, the blade shown in FIG. 5 involves the problem of non-uniformity of the toner layer thickness resulting from a limit to planarity and the occurrence of "fog" resulting from the former.

These problems are particularly serious when a nonmagnetic one-component developer is used. When such a developer is used, the toner layer thickness-limiting blade must be able to come into uniform pressure contact with the developing roller at a constant pressure, to uniformly limit the toner thickness to a predetermined thickness and to uniformly charge the toner without inviting deterioration of the toner.

The resolution required of the one-component developer has increased year by year, in digital copying machines and printers, and the requirement for toners having smaller particle sizes has become stronger. Recently, toners having small particle diameters, the weight mean particle diameters of which fall within the range of about 6.0 to 10.0 $\mu$m, have been frequently used in these apparatuses. Furthermore, toners that can be fixed even at a low temperature have been required to cope with the energy saving trend of the apparatuses, and the thermal characteristics of the toners have been shifted to the lower temperature side with the requirement for color printing.

Under such circumstances, the following problem develops when a "toner having a weight average particle diameter of 6.0 to 10.0 $\mu$m and low thermal characteristics (that is, fixable at a low temperature)" is used in the developing devices explained above with reference to FIGS. 1 to 5. As the developing roller is rotated for a long time while the blade is kept in pressure contact with the developing roller, the toner receives thermal/mechanical stress when it passes under the blade and, consequently, the toner is fused at the distal end of the blade as printing is repeated. As a result, stable formation of the toner layer is impeded on the photosensitive drum and white stripes occur and deteriorate image quality.

As described above, in the image formation apparatus that forms an electrostatic image on an image support by the electrophotographic process and develops it by using a developer to a visible image, a developing device using a one-component developer is more advantageous from the aspects of the size and cost of the device and reliability. To form a color image, in particular, a nonmagnetic one-component developer is advantageous because it has high transparency.

Developing devices of various types use the nonmagnetic one-component developer. A typical developing device includes a developer support that supports the one-component developer on its surface and transfers it along a predetermined circulation path inclusive of a developing region, storing means for storing the one-component developer and developer feeding means coming into contact with the developer support, for feeding the one-component developer stored in the developer storing means to the developer support. Such a developing device is described in detail in, for example, Japanese Unexamined Patent Publications (Kokai) No. 60-229057 and No. 61-42672.

FIG. 6 schematically shows an example of the developing device described above. The developing device 110 is equipped with a casing 113 for defining a developer container (toner hopper) that stores a nonmagnetic one-component developer not containing a magnetic material and comprising only a toner, that is, a nonmagnetic toner 111, and includes, inside this casing 113, a developing roller 114, a sponge roller 115 for supplying the developer to the developing roller 114, and a thickness limiting blade 116 for limiting the thickness of the developer on the surface of the developing roller 114. A suitable developing bias voltage can be applied from a bias power source 121 to the developing roller 114.

Fine silica powder, for example, is added as an additive to the nonmagnetic toner 111. Fine silica powder has the function of controlling the frictional charge quantity of the toner 111 and can contribute to the improvement of the image density. The developing roller 114 is so disposed as to oppose and to come into contact with a photosensitive drum 101 that forms an electrostatic latent image, at the opening of the casing 113 and holding it. The developing roller 114 rotates in the same direction as the photosensitive drum 101 at its opposed portion with the latter. In consequence, the developing roller can transfer the toner 111 supported on the developing roller 114 to the photosensitive drum 101.

The sponge roller 115 is made of a sponge material having flexibility. The sponge roller 115 comes into flexible contact with the developing roller 114 on the opposite side to the photosensitive drum 101, rotates in the opposite direction (so-called "counter-rotation") at the contact portion with the developing roller 114, and can simultaneously scrape off the residual toner of development (the toner that is not transferred to the photosensitive drum, hence, is not used for development) and can supply the new toner 111 to the developing roller 114 inside the casing 113. The toner 11 supplied afresh at the sponge roller 115 undergoes friction due to the developing roller 114 and the sponge roller 115, and acquires the charge due to frictional charging, is allowed to adhere to the developing roller 114 by the image force and is transferred. On the other hand, the residual toner of development is scraped-off by the nip generated by the mechanical frictional force between the developing roller 114 and the sponge roller 115. When charging and the supply of the new toner are carried out simultaneously with scraping-off of the residual toner of development in this way, the nip width between the sponge roller 115 and the developing roller 114 is preferably as large as possible to sufficiently obtain these functions. To charge the toner and to scrape off the residual toner, the nip pressure is preferably high. When rotary members such as the sponge roller and the developing roller are used in combination, the effect of substantially increasing the nip width can be obtained when the linear velocity due to the counter rotation is greater. In the conventional developing devices of this kind, therefore, it has been customary to stipulate the hardness of the sponge roller or the nip width with the developing roller (for example, Japanese Unexamined Patent Publication (Kokai) No. 7-44023), or to set the linear velocity of the sponge roller to a higher level than the linear velocity of the developing roller.

The thickness-limiting blade 116 is fitted above the developing roller 114 inside the casing 113 and is brought into contact with the peripheral surface of the developing roller 114 in such a fashion as to be capable of counter-rotating with respect to the developing roller 114. Therefore, the thickness-limiting drum frictionally charges the toner 111 during its transfer to the photosensitive drum 101, and the toner thus acquires the frictional charge. To effectively impart this frictional charge to the toner 111, a member that is charged in the opposite polarity to the charge polarity of the toner 111 is disposed, in some cases, on the contact surface of the thickness-limiting blade 116 with the developing roller 114. The toner 111 transferred to the developing region on the photosensitive drum 101 is used for developing the electrostatic latent image that has already been formed in this region.

The conventional image formation apparatuses using the developing device of this kind, however, employ a construction wherein the sponge roller 115 executes counter-rotation with a large nip width and a high nip pressure with respect to the developing roller 114, and has a higher linear velocity than that of the developing roller. Therefore, the following problems develop.

1) Mechanical torque becomes high.

2) Mechanical stress on the toner increases, and deterioration of image quality is accelerated.

3) The toner supply quantity to the sponge roller becomes excessive, and the density of the lastly printing portion increases.

In view of the facts described above, these problems can be solved by reducing the nip width of the sponge roller 115 relative to the developing roller 114 and the nip pressure, and by further bringing the linear velocity of the sponge roller 115 close, or equal, to the linear velocity of the developing roller 114.

However, when the linear velocity of the sponge roller 115 is brought close, or equal, to the linear velocity of the developing roller 114, the following new problems arise.

4) Since the quantity of the toner supplied from the sponge roller to the developing roller becomes insufficient, a negative after-image occurs in the sponge roller cycle.

5) Since the frictional charge of the toner is insufficient, non-uniformity in the charge quantity of the toner, deterioration of image quality such as photographic fog of the background, deterioration of development and transfer, and a drop in resolution occur.

6) Since selective development of the toner occurs, a positive after-image occurs in the developing roller cycle.

To begin with, the negative after-image in the sponge roller cycle will be explained. The sponge roller 115 has the function of supplying the toner to the developing roller 114 as described above. The sponge roller 115 can supply a new toner to the positions of the developing roller 114 at which the toner that develops the latent image is lost. After supplying the toner, the sponge roller 115 transfers the new toner from the developer container (toner hopper) defined by the casing 113 and prepares again for supplying the toner. At this time, the difference of the toner quantity that can be supplied to the developing roller 14 occurs at the portion at which the toner is once supplied and the portion at which it is not yet supplied. Insufficiency of the toner occurs at the portion at which the toner is once supplied. Such a difference of the toner quantity results in the difference of density in the resulting toner image. This phenomenon represents the term "negative after-image in sponge roller cycle" as used in this specification. The negative after-image in the sponge roller cycle appears generally at the position of one turn of developing roller+one turn of sponge roller. Particularly, the printing after-image in the solid patch printing that have a large toner consumption quantity is remarkable.

Next, deterioration of image quality resulting from non-uniformity of the toner charge quantity will be explained. When the toner does not undergo sufficient frictional charging between the sponge roller 115 and the having a small particle size, and the toners having a large toner remain inside the toner hopper. When the toner on the developing roller 114 repeats the image formation that needs a small toner consumption quantity such as white solid printing, the toner selection function operates whenever the toner passes through the nip between the developing roller 114 and the sponge roller 115. Consequently, the particle size of the toner on the developing roller becomes smaller and smaller. Because the toner having a high charge adheres strongly to the developing roller, the potential of the toner layer becomes high. When the developing roller executes printing with high toner consumption such as black solid patch printing, a new toner is supplied to the position at which the toner is consumed. However, this toner has a greater toner particle diameter and a smaller charge quantity than the toner at portions at which printing does not exist. Therefore, the toner layer at this portion has obviously a different condition from the condition of the neighboring toner layers, and generates the phenomenon in which printing becomes dense (positive after-image). The selective toner feed phenomenon generates the positive after-image in this way. A positive after-image is a phenomenon that is generated because the toner is not a single substance but has a distribution of chargeability. This chargeability depends mainly on the size of the particle diameter. Since the selective toner feed phenomenon is the one that results from the difference of chargeability, it is likely to occur remarkably under the developing condition described above where satisfactory charging is not made, hence, the positive after-image, too, is likely to occur.

SUMMARY OF THE INVENTION

The present invention is directed to solve the problems of the prior art technologies described above.

It is an object of the present invention to provide an image formation method that can use a toner layer developing roller 114, the toner supplied to the developing roller 115 does not reach the saturation charge quantity. Consequently, the toner contains the toner that is hardly charged or is not at all charged, or the toner that is oppositely charged. Then, the toner having these inappropriate charge quantities hinders development transfer to the latent image with fidelity, and causes photographic fog of the base due to adhesion to the background portion or deterioration of resolution such as the failure of a delicate expression using repeated separate many dots. These problems can be solved when the toner supplied undergoes complete saturation charge.

Next, the positive after-image in the developing roller cycle will be explained. A positive after-image is a phenomenon in which the printing density of the position at which printing is made becomes high, contrary to the negative after-image. The positive after-image occurs in the rotating cycle of the developing roller. The mechanism of the occurrence of the positive after-image is closely associated with the development mechanism by the nonmagnetic one-component developing method. The toner supplied from the sponge roller 115 adheres to the developing roller 114 by the image force due to its charge, as described above. Therefore, the adhesion force is proportional to the magnitude of the charge. The greater the charge, the more likely is the toner to adhere to the developing roller 114, and the smaller the charge, the more difficult it is for the toner to adhere to the developing roller 114. As a result, the toner is selectively supplied to the developing roller 114 depending on the charge quantity (that is, the selective toner feeding phenomenon). According to an investigation done by the present inventors, the toner having a high charge quantity is the toner that has a small particle diameter. The toners are supplied selectively from the toners thickness-limiting blade capable of exhibiting the function of the layer thickness limitation or triboelectrical charging, or both of them, in combination with a toner having a weight average particle diameter of 6.0 to 10.0 μm and low heat characteristics, is hence simple in construction and can provide high image quality and, moreover, high reliability.

It is another object of the present invention to provide an image formation apparatus that will be suitable for executing the image formation method of the present invention.

It is still another object of the present invention to provide an image formation apparatus equipped with a developing device that can prevent the occurrence of the negative after-image of a sponge roller cycle resulting from an insufficient amount of the toner supplied from a sponge roller, background fog due to non-uniform toner charge amount resulting from insufficiency of triboelectrical charge of the toner, deterioration of development transfer and resolution and, furthermore, the positive after-image of a developing roller cycle resulting from selective development of the toner, without inviting deterioration of image quality resulting from toner deterioration and a mechanical torque, while maintaining long-term stability.

It is still another object of the present invention to provide a color image formation apparatus for visualizing colors transmitting through the toner such as color images and, eventually, a color image formation apparatus using the toner the image density of which does not get into saturation with respect to its adhesion amount, that is, the toner the melt-viscosity of which is limited to a certain range, at the time of fixing. When such a toner is used, the melt-viscosity at the time of fixing is appropriate, and the smoothness of the image can be improved. Consequently, a high quality image having luster can be formed.

The above and other objects of the present invention will be appreciated more clearly from the description set forth below with regard to the preferred embodiments thereof.

According to one aspect of the present invention, there is provided an image formation method for forming a color image by using a contact type nonmagnetic one-component developing device in accordance with an electrophotographic process, characterized in that, inside the developing device, a flat sheet-like blade made of a metal flexible member, and having a distal end thereof chamfered, is used as a toner layer thickness-limiting blade, and a toner having a glass transition point (Tg) of 55 to 70° C., and a weight average particle diameter of 6.0 to 10.0 μm, and containing up to 20 number % of particles having particle diameters of 5 μm or below, is used as a developer.

According to another object of the present invention, there is provided an image formation apparatus for forming a color image, including a contact type nonmagnetic one-component developing device, characterized in that the developing device has a flat sheet-like blade made of a metal flexible member and having a distal end portion thereof chamfered, as a toner layer thickness-limiting blade for limiting a developer layer thickness on a developing roller provide thereto, and a toner having a glass transition point (Tg) of 55 to 70° C. and a weight average particle diameter of 6.0 to 10.0 μm, and containing up to 20 number % of particles having particle diameters of 5 μm or below, is used as the developer stored in the developing device. Hereinafter, this image formation device is called the "first image formation apparatus".

According to still another aspect of the present invention, there is provided an image formation apparatus for forming an image by visualizing an electrostatic latent image by using a developer, including a developing device including a developer container for storing a one-component developer; an image support for forming and holding an electrostatic latent image; a developer support for transferring the developer to a developing region on the image support, disposed opposite to the image support while keeping contact with the image support; a developer feeding member for supplying the developer inside the developer container to the developer support, disposed to be capable of moving while keeping flexible contact with the developer support; and a thickness-limiting member for limiting the thickness of the developer on the developer support, supplied from the developer feeding member; wherein: the developer support is a rotary member having an outer diameter Dd and a surface linear velocity Vd, the developer feeding member is a rotary member having an outer diameter Dr and a surface linear velocity Vr, and the developer support and the developer feeding member satisfy the relation $Dd \geqq Dr$ and $Vd=Vr$; and wherein the one-component developer comprises particles having a weight average particle diameter of 6.0 to 10.0 μm, and containing 0 to 20 number % of particles having particle diameters of 5 μm or below and 0 to 2 vol % of particles having a volume average particle diameter of 12.7 μm or above. This image formation device will sometimes be called the "second image formation apparatus".

The present invention uses the developing device in which the linear velocity of a developer feeding member (typically, the sponge roller, as will be explained later) is set to an equal speed to the linear velocity of a developer support (typically, a developing roller), and the outer diameter of the sponge roller is smaller than the outer diameter of the development roller. Therefore, the present invention can extend the life of the image formation apparatus. At the same time, the present invention uses a toner having a specific particle size distribution. In other words, the volume average particle diameter of the toner particles is within the range of 6 to 10 μm, the proportion of particles having particle diameters of 5 μm or below is within the range of 0 to 20 number %, and the proportion of particles having particle diameters of 5 μm or below is 0 to 20 vol %. In this way, the present invention can prevent particle diameter selection, that is, the phenomenon in which the toners having smaller particle diameters are supplied preferentially between the sponge roller and the developing roller. Even when this particle diameter selection occurs to a certain extent, the present invention can minimize the particle diameter shift of the toner remaining inside a developer container (typically, a toner hopper). When the image formation apparatus according to the present invention is used, therefore, the occurrence of the positive after-image of the developing roller cycle can eventually be prevented.

According to still another aspect of the present invention, there is provided an image formation apparatus for forming an image by visualizing an electrostatic latent image by using a developer, including a developing device and a developer container for storing a one-component developer; an image support for forming and holding an electrostatic latent image; a developer support for transferring the developer to a developing region on the image support, so disposed as to oppose the image support while keeping contact with the image support; a developer feeding member for supplying the developer inside the developer container to the developer support, so disposed as to be capable of moving while keeping flexible contact with the developer support; and a thickness-limiting member for limiting the thickness of the developer on the developer support, supplied from the developer feeding member; wherein: the developer support is made of an electrically conductive material and its electric resistance Rd is $1\times10^3$ to $1\times10^8$ Ω; and the developer feeding member is made of an electrically conductive material, and its electric resistance Rr satisfies the relation:

$$-4<\log(Rd/Rr)\leqq 4(\log(Rd/Rr)\neq 0).$$

Hereinafter, this image formation apparatus will be called the "third image formation apparatus".

In the third image formation apparatus, the developing roller assembled into the developing device is made of an electric conductor, and its electric resistance Rd is $1\times10^3$ to $1\times10^8$ Ω. The sponge roller for supplying the toner is also made of a conductor and its electric resistance Rr is set to $-4\leqq\log(Rd/Rr)\leqq 4(\log(Rd/Rr)\neq 0)$. In this way, the positive after-image of the developing roller cycle can be prevented. The smaller the difference of the electric resistance between Rd and Rr in this image formation apparatus, the more easy it becomes to restrict an unnecessary current applied to the toner. Therefore, when this image formation apparatus is used, the toner can catch the charge by only the charge of pure charge of friction, and non-uniformity of the charge held by the toner decreases. Therefore, the selective supply phenomenon of the toner can be controlled.

In the second and third image formation apparatuses according to the present invention, the charge amount of the one-component developer on the developer support is preferably within the range of −40 to −60 μC/g. When such a charge amount is adopted, the negative after-image of the reset roller cycle and the positive after-image of the developing roller cycle can be prevented.

The charge amount of the one-component developer is preferably within the range of −30 to −50 μC/g within a predetermined time ($Dr\times\pi/Vr$). In other words, in the image formation apparatus of the present invention, the negative after-image of the reset roller cycle can be prevented when the charge amount of the toner on the developing roller is allowed to increase to −30 to −50 μC/g within the predetermined period. The inventors of the present invention have discovered that it is one of the most important factors for preventing the after-image that the charge amount reaches a suitable charge amount at the developing start time and that this suitable charge amount is maintained.

The one-component developer used for the image formation apparatus according to the present invention preferably has a melt-viscosity of 50,000 Pa·sec or below at 100° C.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Hereinafter, the present invention will be explained with reference to some preferred embodiments thereof. However, the present invention is not particularly limited thereto.

An image formation apparatus and a first image formation apparatus according to the present invention forms color images in accordance with an electrophotographic process by using a contact type nonmagnetic one-component developing device. In the method and the apparatus according to the present invention, the mechanism of the image formation is fundamentally the same as the mechanism of a contact type nonmagnetic one-component development that has been practiced ordinarily in the past, as will be explained below.

The image formation method and the apparatus according to the present invention must satisfy the following two requirements.

(1) A toner layer thickness-limiting blade used inside the contact type nonmagnetic one-component developing device is made of a metal flexible member, and its distal end portion is chamfered.

(2) A developer accommodated inside the developing device and used for forming the image is the one that has a glass transition point (Tg) of a toner of 55 to 70° C., a weight average particle diameter of 6.0 to 10.0 μm, and the proportion of particles having particle diameters of 5 μm or below is not higher than 20 number %.

First, the toner layer thickness-limiting blade is made of an arbitrary metal flexible member. Suitable examples of such metal flexible members include steel and particularly, a stainless steel for springs. This member has excellent flexibility that cannot be acquired by the conventional blade materials, and can be easily processed.

The toner layer thickness-limiting blade is generally processed and into and used in the flat sheet shape. A part of the distal end of the flat sheet-like blade is chamfered in a customary manner, and the chamfer portion is further polished. Various methods that are used customarily in the machining field can be used for this polishing treatment, and buffing can be used preferably. Buffing can be conducted by applying a buffing/polishing agent to the surface of a polishing wheel made of a cloth or other materials. Base polishing, finish polishing and luster polishing can be used selectively in accordance with a desired degree of polishing. A solid polishing agent prepared by mixing a polishing agent with a fat, or a liquid polishing agent prepared by dispersing a polishing agent into an emulsion can be used as the buff-polishing agent.

Figure 1:
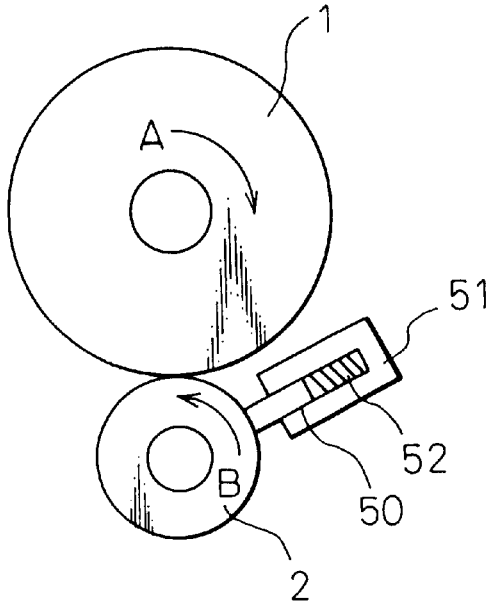
Fig.1 PRIOR ART
FIG. 1 is a sectional view showing an example of a developing device equipped with a toner layer thickness-limiting blade according to the prior art.
Figure 2:
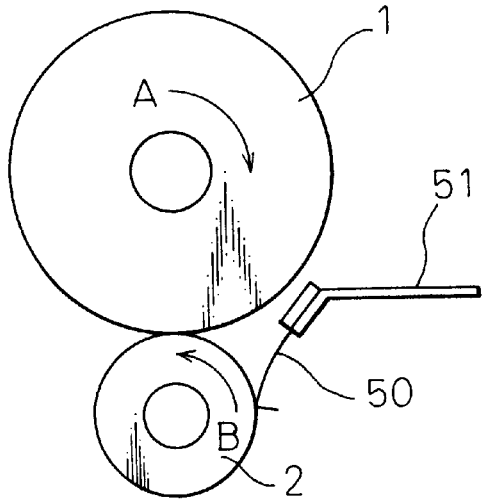
Fig.2 PRIOR ART
FIG. 2 is a sectional view showing another example of the developing device equipped with a toner layer thickness-limiting blade according to the prior art.
Figure 3:
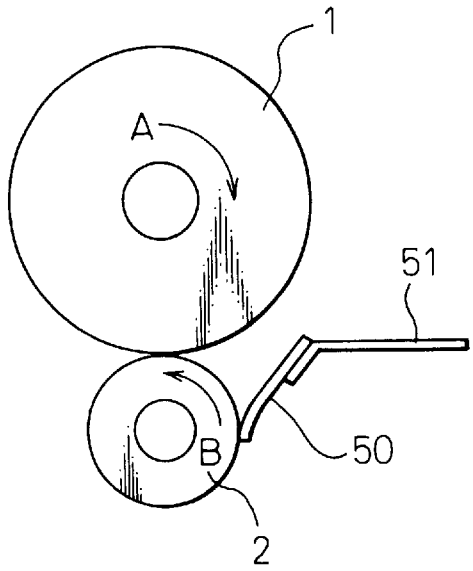
Fig. 3 PRIOR ART
FIG. 3 is a sectional view showing still another example of the developing device equipped with a toner layer thickness-limiting blade according to the prior art.
Figure 4:
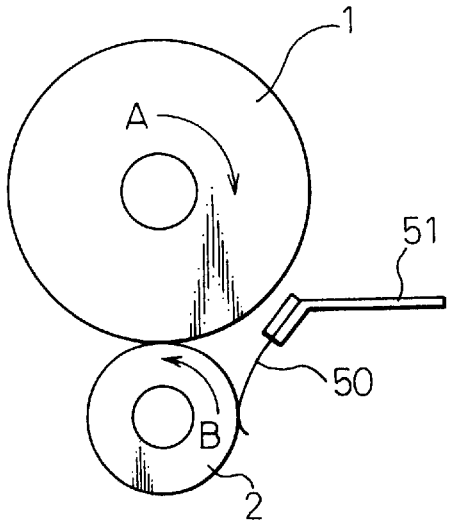
Fig. 4 PRIOR ART
FIG. 4 is a sectional view showing still another example of the developing device equipped with a toner layer thickness-limiting blade according to the prior art.
Figure 5:
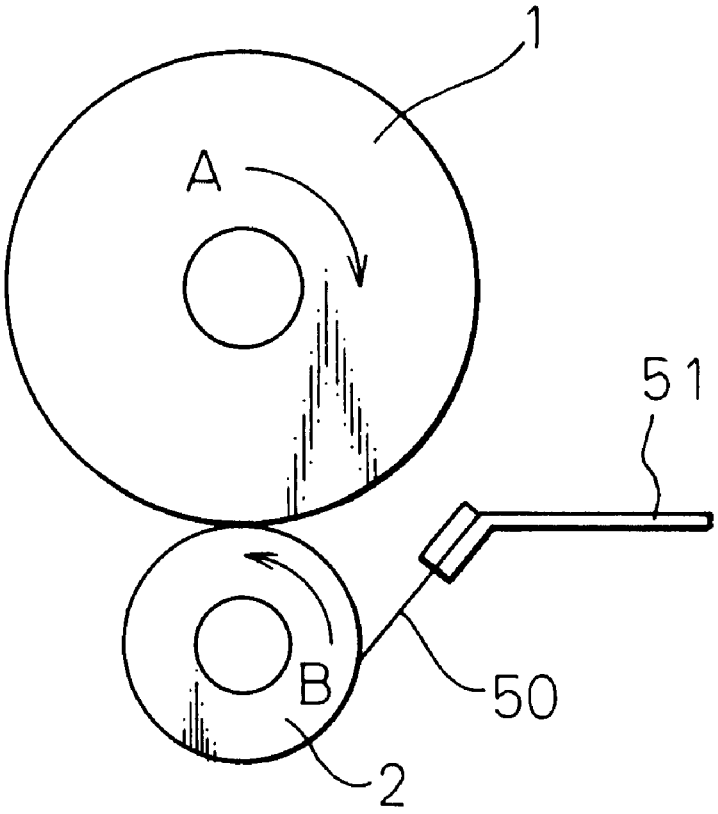
Fig.5 PRIOR ART
FIG. 5 is a sectional view showing still another example of the developing device equipped with a toner layer thickness-limiting blade according to the prior art.
Figure 6:
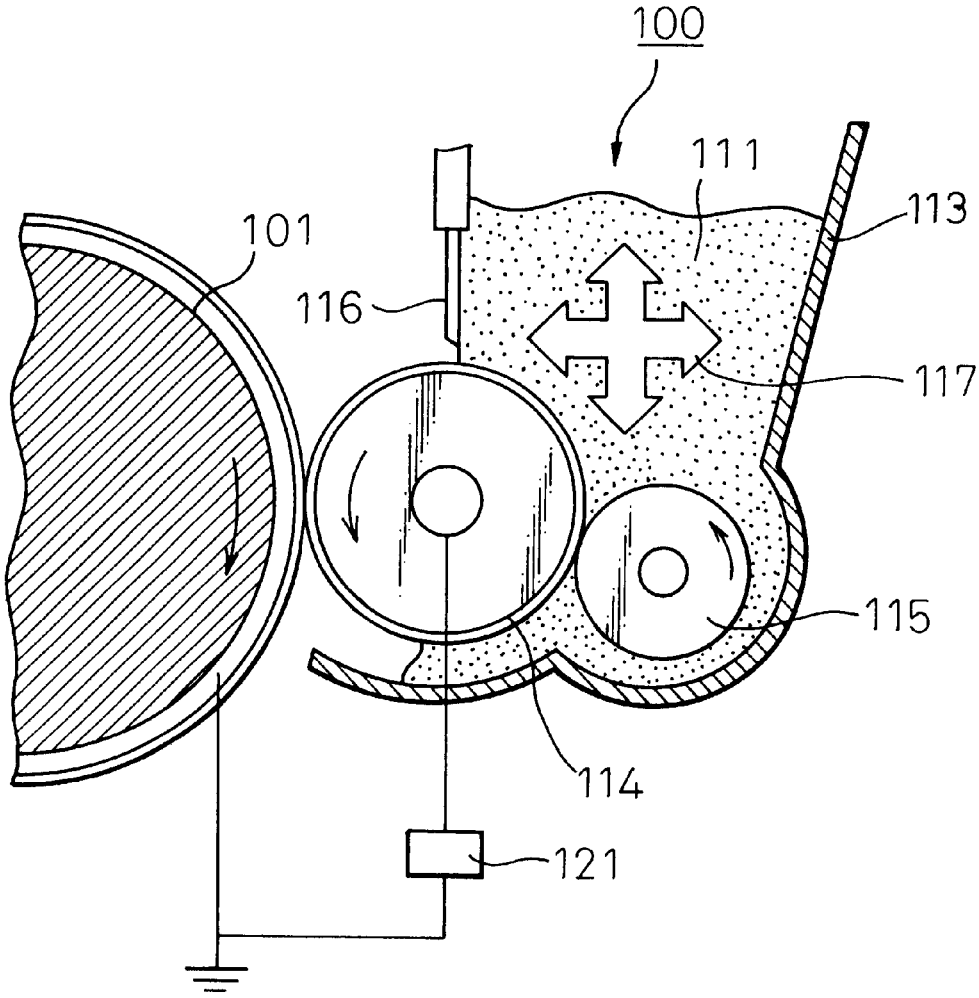
Fig. 6 PRIOR ART
FIG. 6 is a sectional view showing the construction of the developing device used in an image formation apparatus according to the prior art.
Figure 7:
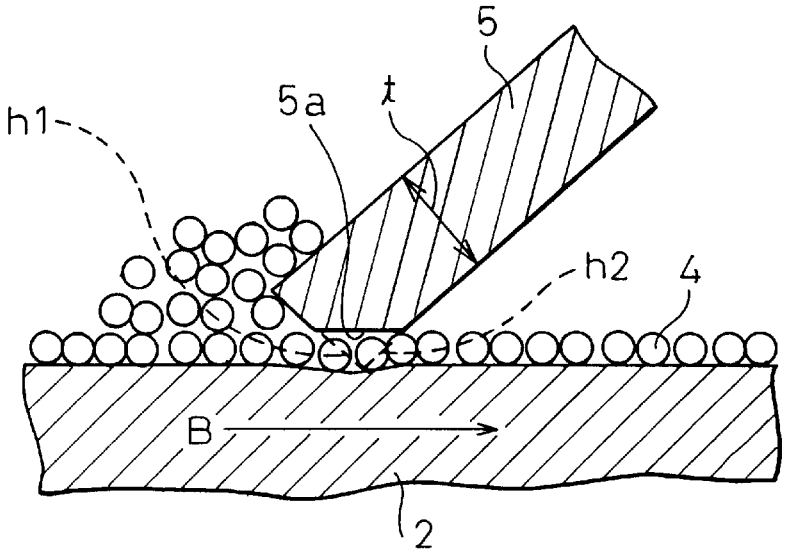
FIG. 7 is a sectional view showing an example where a toner layer thickness-limiting blade according to the present invention is used inside a developing device.

FIG. 7 is a sectional view showing schematically a preferred example of the toner layer thickness-limiting blade described above. The toner layer thickness-limiting blade 5 is produced by machining (chamfering) one of the edges of a member made of a flat sheet-like spring stainless steel as shown in the drawing. Buffing is conducted to finish this chamfer surface 5*a* to a suitable surface coarseness. When the blade 5 is brought into pressure contact at a predetermined pressure with a developing roller 2 rotating in a direction of arrow B, the toner particles enter the gap between the developing roller 2 and the chamfer surface 5*a* of the blade 5, preferably one by one. Consequently, a toner layer having a constant thickness can be stably formed as shown in the drawing.

The surface coarseness Ra of the chamfer surface 5*a* of the toner layer thickness-limiting blade 5 can be changed over a broad range in accordance with the size of the blade, the desired effect, and so forth, but is generally and preferably not greater than 3 μm when the thickness t of the blade is 1 mm.

The toner layer thickness-limiting blade 5 can be positioned at various positions with respect to the developing roller 2, but is preferably disposed at a position such that the chamfer surface 5*a* of the toner layer thickness-limiting blade 5 exists on the normal to the developing roller 2 as shown in FIG. 7. Incidentally, FIG. 7 depicts the surface of the developing roller 2 as a linear shape (it is really a curve) for the ease of explanation.

Figure 8:
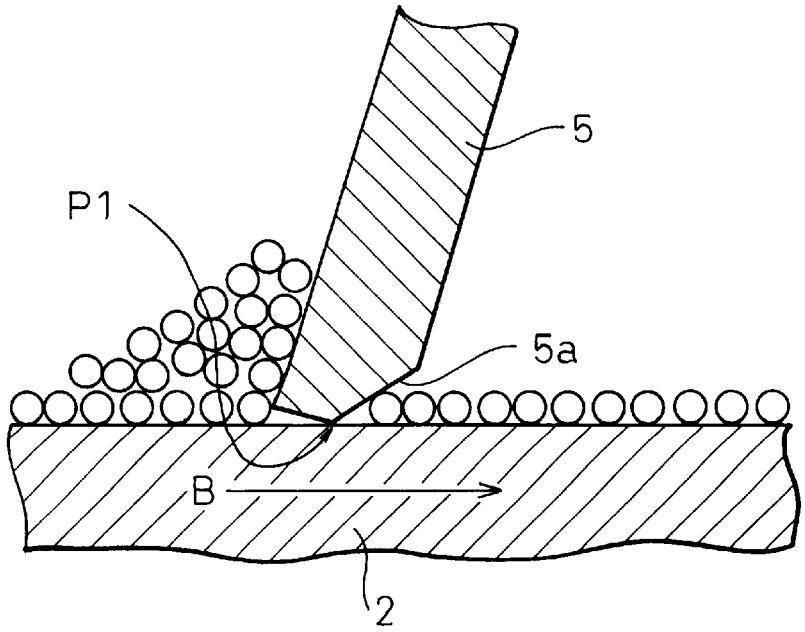
FIG. 8 is a sectional view showing another example where the toner layer thickness-limiting blade according to the present invention is used inside a developing device.
Figure 9:
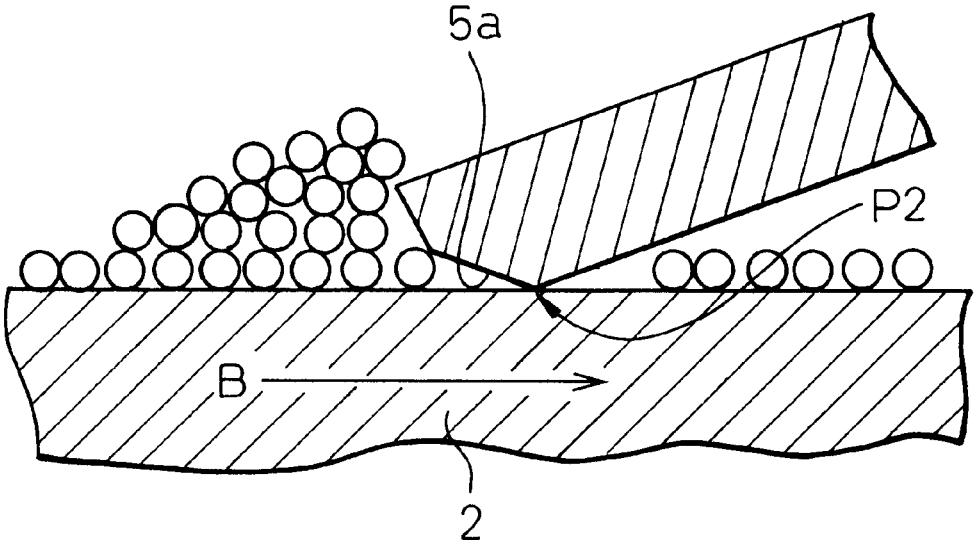
FIG. 9 is a sectional view showing still another example where the toner layer thickness-limiting blade according to the present invention is used inside a developing device.

The toner layer thickness-limiting blade 5 may be disposed, whenever necessary, at the position at which the edge of the chamfer surface of the toner layer thickness-limiting blade 5 comes into contact with the developing roller 2 as shown in FIGS. 8 and 9. In the case of the blade 5 shown in FIG. 8, for example, the edge P1 is brought into pressure contact with the surface of the developing roller 2. In the blade 5 shown in FIG. 9, on the other hand, its edge P2 is brought into pressure contact with the surface of the developing roller 2. In either case, a suitable amount of the toner 4 passes through the gap defined between the developing roller 2 and the chamfer surface 5*a* of the blade 5, and a toner layer 4 having a constant thickness can be formed stably.

The chamfer quantity of the chamfer portion of the toner layer thickness-limiting blade can be varied over a broad range in accordance with the desired quantity. Generally, however, the chamfer quantity hi in the direction of the thickness of the blade 5 preferably satisfies the following relation with the chamfer quantity h2 of the blade in the direction of its width (refer to FIG. 7):

$$1 \leqq h2/h1 \leqq 5$$

When the chamfer quantity is too small or too great, the toner layer 4 cannot be formed in a satisfactory state.

Besides the chamfering described above, the toner layer thickness-limiting blade may be formed by punching out a flat sheet-like metal flexible member such as a stainless steel for springs by using a press type punch with a die. In this instance, the clearance between the punch and the die is set so that an arcuate curve portion having a smooth curve of a punching sag generated by punching the flexible member can be formed. After the blade having a desired shape is obtained by punching, the portion of the blade that comes into contact with the developing roller is polished. Polishing such as the buffing described above can be used advantageously for this polishing.

In the method and the apparatus according to the present invention, the developer stored in the developing device and used for forming the image satisfies the following requirements:

the glass transition point (Tg) of the toner is 55 to 70° C.;

the weight average particle diameter is 6.0 to 10.0 μm; and the proportion of the particles having particle diameters of 5 μm or below is not greater than 20 number %.

When the Tg of the toner used in the present invention exceeds 70° C., desired luster cannot be obtained and moreover, setting of a high fixing temperature becomes necessary. Consequently, large quantities of energy are consumed for fixing the toner image. Particularly when the color toner image is formed, transparency of the color is low and the color reproduction range becomes narrow. When Tg is below 55° C., on the contrary, the toner is fused to the distal end of the blade even when the toner layer thickness-limiting blade of the present invention is used. As a result, the stable formation of the toner layer is impeded, so-called "white stripes" occur, and image quality drops.

When the weight average particle diameter of the toner is less than 6.0 μm or the proportion of the toner particles having particle diameters of not greater than 5 μm exceeds 20 number %, too, the toner is fused to the distal end of the blade, the stable formation of the toner layer is impeded, the "white stripes" occur, and image quality drops. When the weight average particle size exceeds 10.0 μm, on the contrary, thickening occurs in the characters and thin lines occur in the resulting image.

As described above, the image formation method and apparatus according to the present invention can be executed in accordance with the mechanism of the contact type nonmagnetic one-component development. The image formation method and apparatus of this invention can be conducted particularly advantageously for forming the electrostatic latent image in accordance with the electrophotographic process, visualizing the electrostatic latent image by the developer and forming a multi-color toner image. A color superposition system on a drum that forms individually monochromatic toner images of yellow, magenta, cyan and black on the photosensitive drum and then transfers them, and a tandem system (four-drum system) that forms monochromatic color toner images by mutually independent development processes, and then superposes the resulting monochromatic toner images and forms a multi-color toner image, can be employed for forming the color toner image, though these systems are not particularly restrictive. The formation of the color toner image by the tandem system, for example, can be conducted in the following way.

The yellow, magenta, cyan and black monochromatic toner images are formed by a series of process steps listed below:

(1) charging step for imparting photosensitivity to an image support (electrostatic recording medium);

(2) exposure step for conducting image-formation exposure for the image support, and forming and recording the electrostatic latent image; and (3) development step for causing the developer (toner) to be attracted electrically to the electrostatic latent image recorded on the image support and visualizing physically the electrostatic image.

After these process steps;

(4) image transfer step that serially transfers the visible toner images on the image support to a recording medium such as a recording sheet and superposes them; and (5) image fixing step that heats and fixes the transferred image on the recording medium.

The first charging step begins with the preparation of the image support. The image support is a constituent element as the basis of the image formation apparatus, and is typically a photosensitive drum, or the like. The photosensitive drum uses an aluminum drum as its core, and its surface is finished to a mirror surface. A layer of a photosensitive material is further deposited to the surface. Examples of the photosensitive materials are selenium, zinc oxide, cadmium sulfide, organic photoconductors (OPC) and amorphous silicon. Vacuum deposition and coating can be employed as the coating method of the photosensitive material.

A corona charger or a conductive brush charger can be used as the charging device for uniformly charging the image support. The conductive brush charger is free from the problem of the occurrence of ozone unlike the corona charger, and can be therefore used advantageously when the present invention is executed. When a voltage of 500 V to 1.5 kV is applied to the conductive brush, the conductive brush charger can charge the image support to a necessary potential. The conductive brush may be formed by implanting a conductive fiber (such as a rayon fiber, a polyester fiber, etc), to a base cloth and winding the cloth round a conductive core rod, and may be used in the form of a rotary conductive roller. Otherwise, the conductive fibers may be bundled like a brush, and may be used in the form of a sheet-like (bar-like) brush. In the latter case, the size and the cost can be much lower than in the former case.

Subsequently, image-forming exposure is applied to the image support after charging to form an electrostatic latent image and to record this image. Various exposure methods can be used in accordance with the latent image formation step used. Generally, a semiconductor laser optical system, an LED optical system, a liquid crystal shutter (LCS), or the like, can be used as the exposure light source.

After the exposure step is completed, the developing step is conducted by causing the electrostatic latent image recorded on the image support to attract electrically the developer and to physically visualize the electrostatic latent image. This step, too, can be carried out by using various apparatuses in the same way as other steps of the method of the present invention. Though various modifications occur depending on the development system employed, the developing device typically comprises a toner container defined by a casing (toner hopper, that stores a nonmagnetic one-component developer stipulated particularly in the present invention); the image support (described above) capable of forming and holding the electrostatic latent image; the developer support capable of transferring the developer to a development region on the image support and so disposed as to oppose, and come into contact with, the image support; a developer feeding member capable of feeding the developer inside the toner container to the developer support, and so disposed as to come into flexible contact with the developer support and to be capable of moving; and a toner layer thickness-limiting blade, that is particularly stipulated in the present invention, for limiting the thickness of the developer supplied from the developer feeding member on the developer support.

The developer support, that can transfer the developer to the development region on the image support such as the photosensitive drum and is so disposed as to oppose, and come into contact with, the image support, is preferably made of an electric conductor, and is typically a developing roller or a developing sleeve. The developing roller, for example, includes an aluminum roller as its core metal and a resin coating applied to its surface. A fiber brush, or the like, may be implanted to the roller surface, whenever necessary.

The developer feeding member, that can feed the developer inside the toner container to the developer support and is so disposed as to be capable of coming into flexible contact with the developer support and moving, is preferably made of a conductor, and is typically a sponge roller or a fur brush. The sponge roller, for example, includes an aluminum roller as its core metal and a porous resin coating on its surface. Alternatively, the roller may comprise substantially wholly a sponge material having flexibility such as urethane foam.

The toner layer thickness-limiting blade used for limiting the thickness of the developer supplied from the developer feeding member to the developer support is made of the flat sheet-like blade which is made of the metal flexible member and the distal end of which is chamfered as described above. The blades shown in FIGS. 7 to 9 are used particularly preferably.

The developing device used in the embodiments of the present invention may include a toner agitation mechanism, a toner density control mechanism, a toner feeding mechanism, a developing bias control mechanism, etc, in addition to the typical constituent elements described above. Incidentally, these mechanisms are well known to those skilled in the art, and explanations are omitted.

After the electrostatic latent image on the image support is visualized and the toner image is formed, the toner image is transferred and recorded electrostatically on a recording medium such as a recording sheet. A corona discharge process, a roller transfer process, a belt transfer process, etc, can be used as the electrostatic transfer process. In the tandem system explained in this embodiment, this transfer process is carried out so that the monochromatic toner images of yellow, magenta, cyan and black can be serially superposed on the recording medium.

Further subsequently, the toner image so transferred and superposed onto the recording medium is heated and fixed. Various heating means such a heat roll fixing process, a flash fixing process and an oven fixing process can be used as a suitable fixing process.

When the present invention is executed, an apparatus necessary for conducting the electrophotographic process, such as a cleaning device, a de-charger, and so forth, known in this field, can be used in addition to the various apparatuses described above. Since these apparatuses are well known to those skilled in the art, too, explanations in detail are omitted.

Figure 10:
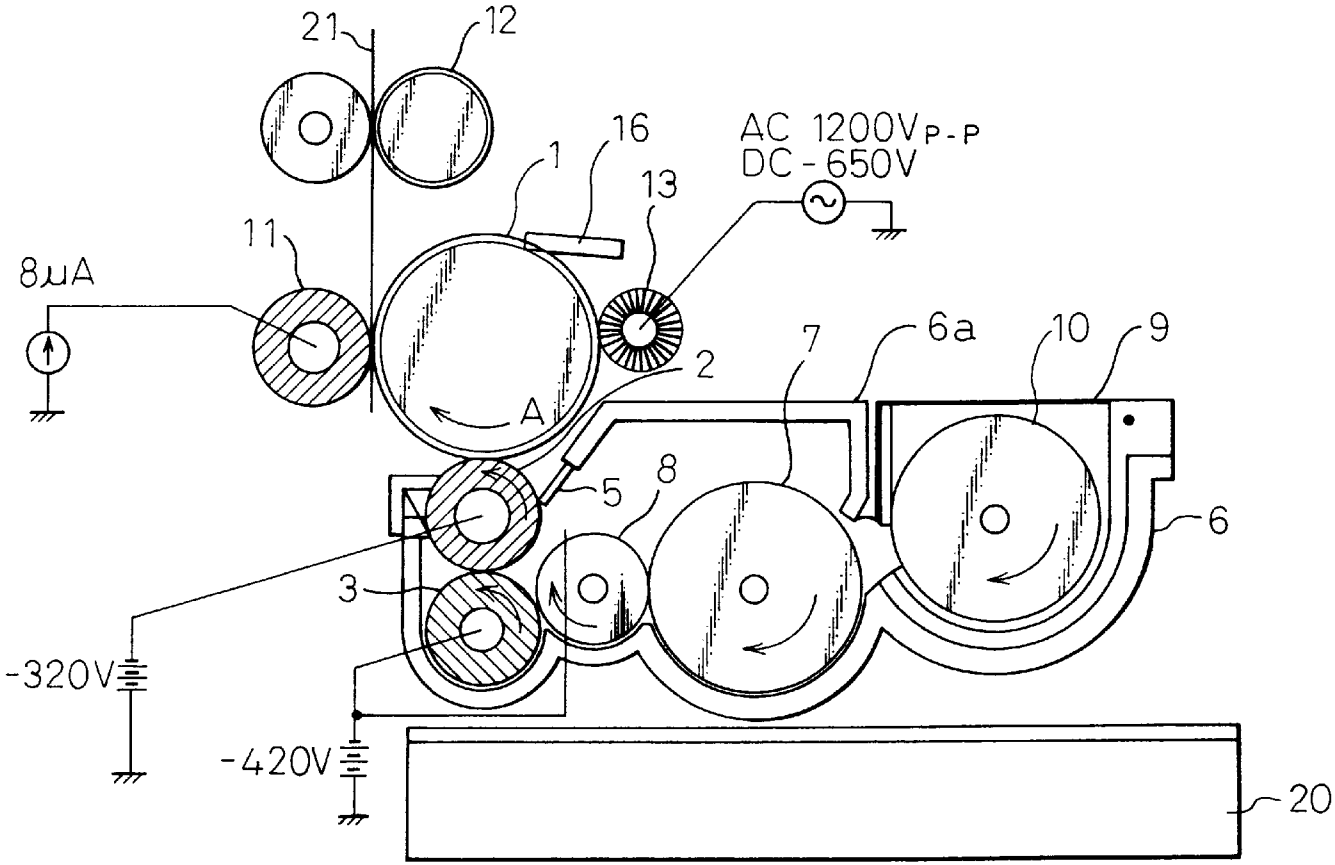
FIG. 10 is a sectional view showing an example of an image formation apparatus that uses the toner layer thickness-limiting blade according to the present invention.

The image formation method and apparatus according to the present invention will be explained further. FIG. 10 is a sectional view of an image formation apparatus using the toner layer thickness-limiting blade according to the present invention. In the drawing, reference numeral 1 denotes a photosensitive drum (having a diameter of 30 mm) made of OPC. This photosensitive drum 1 rotates in the direction indicated by arrow A at a peripheral speed of 57 mm/s. Pre-charging is conducted by using a rotary brush 13, and the photosensitive drum 1 is charged to a surface potential of −650 V. Printing information is generated in the form of a latent image as a laser scanning optical system (not shown) irradiates light onto the photosensitive drum 1 in accordance with the information. Next, the nonmagnetic one-component developing device 6 visualizes the latent image thus formed.

As shown in FIG. 10, the nonmagnetic one-component developing device 6 comprises a developing roller 2, a toner supply/recovery roller 3, a toner (not shown) stored in a developing device frame 6*a*, a toner layer thickness-limiting blade 5 having also the function of charging, an agitator 7, a paddle 8, a toner bottle 9 and an outer 10. In the developing portion, the developing roller 2 keeping contact with the photosensitive drum 1 rotates at a peripheral speed twice that of the photosensitive drum in the same direction, shapes the toner supplied from the roller 3 into a thin toner layer, allows this toner layer to adhere to the latent image portion of the photosensitive drum 1 and forms the visualized image. The toner that does not participate in the development is scraped off by the roller 3 that rotates in the opposite direction below the developing roller 2, and is returned into the developing device 6 through the portion below the roller 3.

On the other hand, the new toner is supplied by the revolution of the roller 3 to the developing roller 2 and is carried to the blade 5. The blade 5 limits the toner layer thickness, and the thin layer toner is formed on the surface of the developing roller 2.

The toner is supplied while the agitator 7 agitates and carries the toner discharged from the toner bottle 9 to the outer 10 to the side of the developing roller 4. The paddle 8 can efficiently supply the toner to the roller 3.

In the transfer portion, the transfer roller 11 causes the sheet of paper to attract the toner adhering to the photosensitive drum. The fixing device 12 then fuses and fixes the toner to the sheet of paper. Incidentally, the sheet of paper 21 is supplied from the sheet hopper 20.

Figure 11:
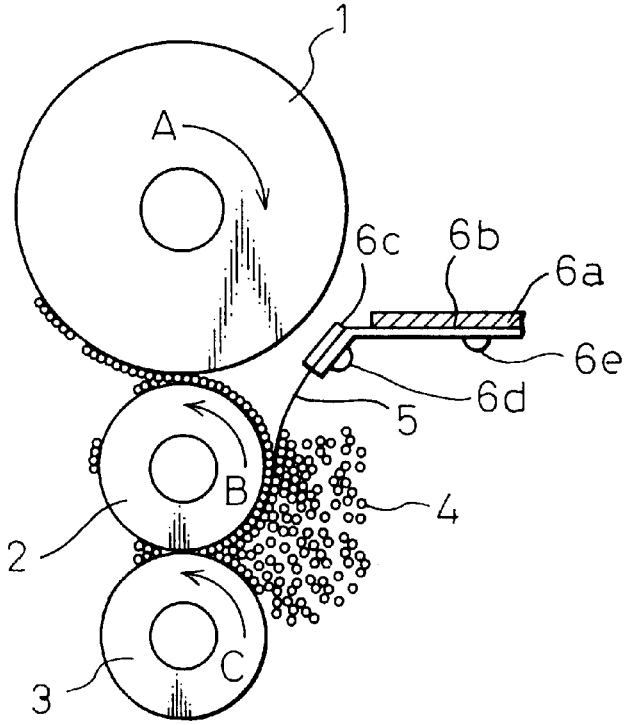
FIG. 11 is a sectional view showing a development portion of the image formation apparatus shown in FIG. 10.

FIG. 11 is a schematic view of the developing portion of the image formation apparatus shown in FIG. 10. Arrows A, B and C represent the rotating directions of the photosensitive drum 1, the developing roller 2 and the roller 3, respectively. As shown in this drawing, the developing roller 2 rotating in the direction of the arrow B is disposed in the proximity of, or in contact with, the roller-like photosensitive drum 1 rotating in the direction of the arrow A. The roller 3 rotating in the direction of the arrow C is disposed in contact with the developing roller 2. The toner layer thickness-limiting blade 5 according to the present invention is interposed between the photosensitive drum 1 and the roller 3 in such a fashion that the distal end of this blade 5 opposes the developing roller 2 in its rotating direction B and is brought into sliding contact with the developing roller 2. The fitting method of the blade 5 is as follows. The blade 5 is fixed, at its proximal end, integrally with a support plate 6*c* and a screw 6*d* to a holder 6*b* made of an insulating resin. The holder 6*b* is in turn fixed by a screw 6*e* to the developing device frame 6*a*.

In the construction of the developing portion shown in FIG. 11, an impressed voltage of −420 V is applied to the roller 3 and an impressed voltage of —320 V is applied to the developing roller 2. The toner 4 carried by the revolution of the roller 3 is electrically charged by the charge injection and the triboelectrical charge of the developing roller 2 that keeps contact and rotates with the roller 3, and adheres to the surface of the developing roller 2.

The toner 4 adhering to the developing roller 2 undergoes higher frictional charge due to the pressure friction and charge injection between the blade 5 and the developing roller 2 due to the revolution of the developing roller 2, and passes between them while forming a toner layer having a predetermined uniform thickness. The toner is then carried to the development region where the developing roller 2 and the photosensitive drum exist in the proximity of each other, or oppose each other.

Next, a part of the toner 4 on the developing roller 2 adheres to the electrostatic latent image formation portion on the photosensitive drum 1 and visualizes this latent image. The rest of the toner that does not participate in the visualization of the latent image returns to the roller 3 with the revolution of the developing roller 2. The roller 3 scrapes off the residual toner 4 on the developing roller 2. However, almost all of the toners 4 are not scraped off but are merely agitated and pass over the contact portion with the roller 3.

As the operation described above is repeated, the developing step of the method and apparatus of the present invention is completed.

Figure 12:
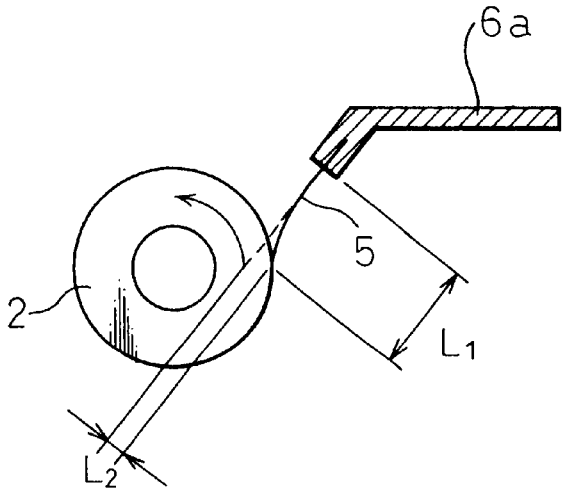
FIG. 12 is a sectional view showing a pressure-contact state of the toner layer thickness-limiting blade of the present invention with a developing roller.

Here, the toner layer thickness-limiting blade 5 as one of the features of the present invention will be explained further with reference to FIG. 12. The size of the blade 5 is preferably so set as to satisfy the following condition, for example.

$L1=16\pm4$ mm, $L2=1\pm0.2$ mm, h1=20±10 μm, and h2=40±10 μm.

Here, h1 is the chamfer quantity of the blade in the thickness-wise direction and h2 is the chamfer quantity of the blade in the width-wise direction as explained previously with reference to FIG. 7.

Figure 13:
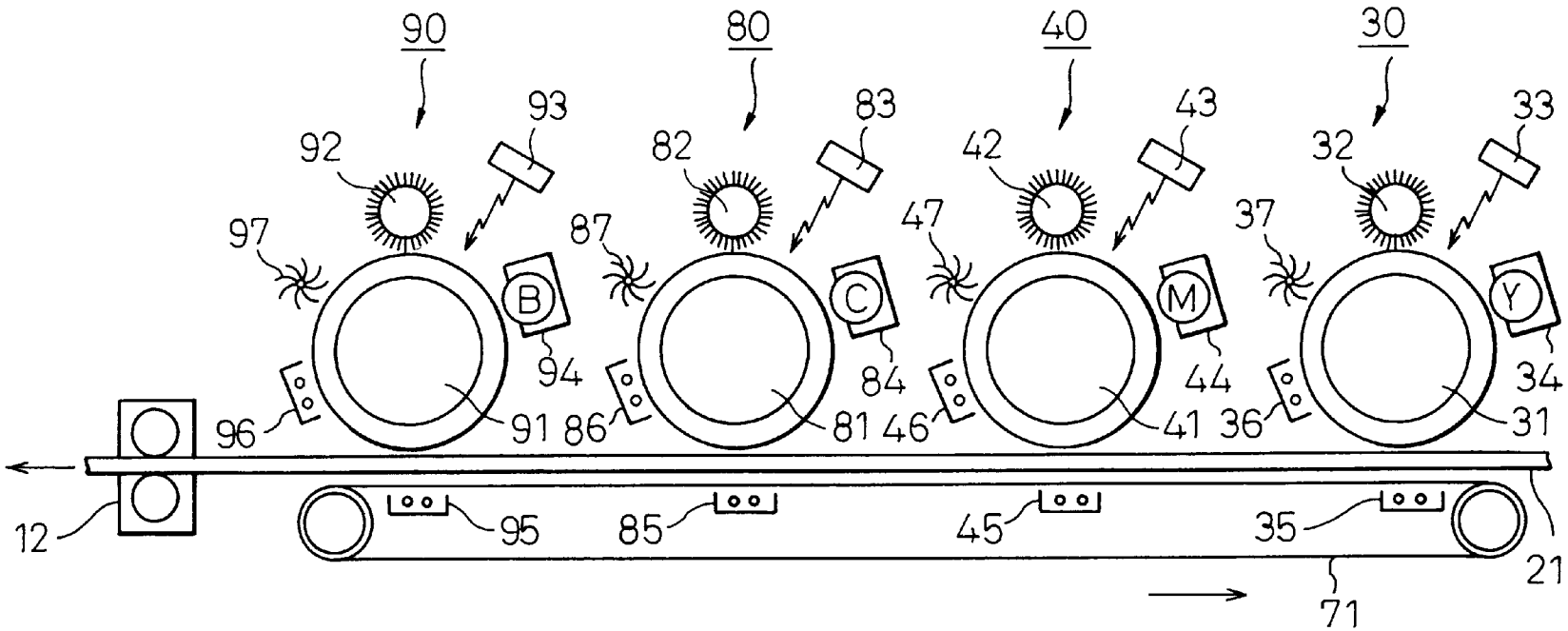
FIG. 13 is a sectional view showing an example of a tandem type color image formation apparatus that uses the toner layer thickness-limiting blade of the present invention.

FIG. 13 is a sectional view of a tandem system color image formation apparatus that uses the toner layer thickness-limiting blade according to the present invention. As shown in the drawing, image formation units 30, 40, 80 and 90 for forming monochromatic images of yellow, magenta, cyan and black are disposed in the transfer direction (represented by arrow) of the sheet 21, respectively. Each image formation unit comprises a charging device for applying the charge to the surface of a photosensitive drum, an exposing device for forming a latent image, a developing device for visualizing the latent image by the use of a developer and forming a toner image, a transferring device for transferring the visualized toner image to a sheet as an image recording medium, a de-charging device for removing the charge remaining on the surface of the photosensitive drum and a cleaning device for removing the toner remaining on the photosensitive drum after transfer, with the photosensitive drum as the image support being the center of these devices. The yellow image formation unit 30, for example, comprises a conductive brush charging device 32, an exposing device 33, a developing device 34, an image transferring device 35, a de-charging device 36 and a cleaning device with a photosensitive drum 31 being the center of these devices. The magenta image formation unit 40, the cyan image formation unit 80 and the black image formation unit 90 have the same construction as that of the yellow image formation unit 30 as shown in the drawing. A transfer belt 71 is a semi-conducting dielectric belt capable of moving in the direction of arrow and capable of attracting and transferring electrostatically the sheet of paper 21. The image fixing device 12 fuses and bonds the image comprising yellow, magenta, cyan and black to the sheet of paper 21 and in this way, the formation of the intended full-color color image is completed.

In the practice of the present invention, the developer used for visualizing the electrostatic latent image is a nonmagnetic one-component developer. As explained already, the present inventors have discovered that when this developer is used under a specific condition, the mode of operation and effect peculiar to the present invention can be fully exploited. Since the nonmagnetic one-component developer need not conjointly use the carrier, means for mixing and agitating the toner becomes unnecessary, and the size of the developing apparatus can be preferably reduced. In this developer, a magnetic material need not be mixed with the toner, and the toner has high transparency and can be shaped into a thin film. Therefore, this effect can be exhibited when forming the full-color image. This one-component developer can fundamentally have the same composition as that of the one-component developer used customarily, and can be therefore prepared by the same method. Needless to say, however, the particle diameter of the developer and its thermal characteristics must be managed on the guideline described above in the present invention.

A binder resin as the principal agent of this one-component developer (hereinafter called the "developer" or the "toner") includes various resin materials. Examples of suitable binder resins include a polyol resin; styrene and its substitution polymers such as polystyrene, poly(p-chlorostyrene) copolymer, polyvinyl toluene, etc; styrene copolymers such as a styrene-p-chlorostyrene copolymer, a styrene-propylene copolymer, a styrene-binyltoluene copolymer, a styrene-vinylnaphthalene copolymer, a styrene-acrylate copolymer, a styrene-methyl acrylate copolymer, a styrene-ethyl acrylate copolymer, a styrene-butylacrylate copolymer, a styrene-octylacrylate copolymer, a stryrene-methylmethacrylate copolymer, a styrene-ethylmethacrylate copolymer, a styrene-butyl- methacrylate copolymer, a styrenemethyl α-chloromethacrylate, a styrene-acrylonitrile copolymer, a styrene-vinylethylether copolymer, a styrene-vinylmethyl ketone copolymer, a styrene-butadiene copolymer, a styrene-isoprene copolymer, a styrene-acrylonitrile-indene copolymer, a styrene-maleic acid copolymer, a styrene-maleate copolymer, etc; polymethyl methacrylate, polybutyl methacrylate, polyvinyl chloride, polyvinyl acetate, polyethylene, polypropylene, a polyester, an epoxy resin, an epoxy polyol resin, a polyurethane, a polyamide, a polyvinyl butyral, a polyacrylic acid resin, rosin, modified rosin, a turpentine resin, a phenol resin, an aliphatic or alicyclic hydrocarbon resin, an aromatic petroleum resin, hydrogenated paraffin, paraffin wax, and so forth. These examples are merely illustrative but not restrictive. These binder resins may be used either alone or as a mixture of two or more.

Coloring agents, too, can be used as the developer components. Known dyes and pigments that are ordinarily used for the developer can be all used as the coloring agents. Suitable examples of coloring agents are carbon black, nigrosine dyes, iron black, Naphthol Yellow S, Hansa Yellow (10G, 5G, G), cadmium yellow, yellow iron oxide, yellow soil, yellow lead, titanium yellow, polyazo yellow, oil yellow, Hansa Yellow (GR, A, RN, R), pigment yellow L, benzene yellow (G, GR), permanent yellow (NCG), Balkan Fast Yellow (5G, R), Tartrazine lake, quinoline yellow lake, anthrazine yellow BGL, isoindolinone yellow, iron oxide red, minium, crocoisite, cadmium red, cadmium mercury red, antimony vermilion, permanent red 4R, Para Red, Phiser Red, parachloro-o-nitroaniline red, Resol Fast Scarlet C, Brilliant Fast Scarlet, Brilliant Carmine BS, permanent read (F2R, F4R, FRL, FELL, F4RH), Fast Scarlet VD, Balkan Fast Rubin B, Brilliant Scarlet G, Resol Rubin GX, Permanent Red F5R, Brilliant Carmine 6B, Pigment Scarlet 3B, Bordeaux 5B, Toluidine Maroon, Permanent Bordeaux F2K, Hellio Bordeaux BL, Bordeaux 10B, Bon Maroon Light, Bon Maroon Medium, eosine lake, Rhodamine Lake B, Rhodamine Lake Y, Alizaline Lake, thioindigo red B, thoindigo maroon, oil red, quinacridone red, pyrazoline red, polyazo red, chromium vermilion, benzibenzizine orange, perinone orange, oil orange, cobalt blue, cellurian blue, alkali blue lake, peacock blue lake, Victoria blue lake, nonmetallic phthalocyanine blue, phthalocyanine blue, fast sky blue, Indanthrene Blue (RS, BC), indigo, ultramarine, Berlin Blue, anthraquinone blue, fast violet B, methyl violet lake, cobalt purple, manganese purple, dioxane violet, anthraquinone violet, chromium green, zinc green, chromium oxide, pyridian, emerald green, pigment green B, naphthol green B, green gold, acid green lake, Malachite green lake, phthalocyanine green, anthraquinone green, titanium oxide, zinc white and lithophone. These coloring agents may be used either alone or as a mixture of two or more. The use amount of the coloring agent can be changed in a broad range in accordance with the kind of the developer to which the pigment is added, and with the desired effect. Generally, however, the amount of the coloring agent is 0.1 to 50 parts by weight to 100 parts by weight of the binder resin.

In the method of the present invention, the toners of a plurality of colors used for forming the color image may be arbitrary, but are preferably those which can reproduce full-color. When the toners of a plurality of colors other than black are three colors of yellow, cyan and magenta, the number of times of development may be small, and they can cover a relatively broad color tone range.

The developer according to the present invention may contain a charge controller, whenever necessary. Known charge controllers in the developer can be all used in the present invention. Though not restrictive, preferred examples of the charge controllers are a nigrosine type dye, a triphenylmethane type dye, a chromium-containing metal complex dye, a molybdic acid chelate pigment, a rhodamine type dye, an alkoxy type amine, a quaternary ammonium salt (inclusive of fluorine-modified quaternary ammonium salt), alkylamide, a single substance or compound of phosphorus, a single substance or compound of tungsten, a fluorine type surfactant, a metal salicylate, and a metal salt of a salicylic acid derivative. More concrete examples of the charge controller are "Bontron 03" as a nigrosine type dye, "Bontron P-51" as a quaternary ammonium salt, "Bontron S-34" as a metal-containing azo dye, "E-52" as an oxynaphtoic acid type metal complex, "E-84" as a salicylic acid type metal complex, "E-59" as a phenol type condensate (all being the products of Orient Chemical Industry, Co.), "TP-302" and "TP-415" as quaternary ammonium salt molybdenum complex (products of Hodogaya Kagaku Kogyo K.K.), "Copy-Charge SPY VP2038" as a quaternary ammonium salt, "Copy Blue PR" as a triphenylmethane derivative complex, "Copy-Charge NEG VP2036" or "Copy-Charge NX VP434" as a quaternary ammonium salt (products of Hoechst Co.), "LRA-901" and "LR-147" as a boron complex (products of Japan Carlit Co.), a copper phthalocyanine pigment, a perillene pigment, a quinacridone pigment, an azo type pigment and other polymeric compounds containing a functional group such as a sulfonic acid group, a carboxylic group, a quaternary ammonium salt, and so forth. These charge controllers may be used either alone or as a mixture of two or more kinds.

The amount of the charge controller used in the developer is determined by the kind of the binder resin, the existence/absence of the additive that is added, whenever necessary, and the toner production method inclusive of the dispersion method, and is not therefore determined primarily. Preferably, however, the use amount is within the range of 0.1 to 10 parts to 100 parts by weight of the binder resin. The use amount of the charge controller is more preferably within the range of 2 to 5 parts by weight. When the use amount of the charge controller is less than 0.1 parts by weight, the negative charge of the toner is insufficient and is not practical. When the use amount of the charge controller exceeds 10 parts by weight, on the other hand, chargeability of the resulting toner becomes too great, and the increase of the electrostatic attraction force with the developing roller invites a drop in the image density resulting from so-called "spent" and filming.

The developer used in the present invention preferably contains a wax to secure mold releaseability of the developer. A suitable wax suitable for imparting releaseability has a melting point within the range of 40 to 120° C. and particularly preferably, within the range of 50 to 110° C. When the melting point of the wax is excessively high, the fixing property at a low temperature is likely to become insufficient. When the melting point is excessively low, offset resistance and durability drop in some cases. Incidentally, the melting point of the wax can be determined by the differential scanning calorimetry (DSC). In other words, the melting peak value when several milligram of the sample is heated at a predetermined heating rate such as 10° C./min is used as the melting point.

Examples of the wax that can be used for the developer of the present invention, though they are not restrictive, include solid paraffin wax, micro-wax, rice wax, aliphatic amide type wax, aliphatic acid type wax, aliphatic mono-ketones, aliphatic metal salt type wax, aliphatic ester type wax, partially saponified aliphatic ester type wax, silicone varnish, higher alcohols, and carnauba wax. Polyolefins such as low molecular weight polyethylene, polypropylene, etc, can be used as the wax, too. Particularly preferred is polyolefin wax having a softening point (measured by the ring-and-ball method) within the range of 70 to 150° C. and further preferably, within the range of 120 to 150° C. These waxes may be used either alone or as a mixture of two or more kinds.

The developer used in the present invention can be prepared by mixing the constituent materials described above in a customary manner. To prepare a black toner and a plurality of toners, for example, the constituent materials are mixed by using a mixer such as a Henschel mixer and are then heated and kneaded by a using a continuous kneader or a roll kneader. After the kneaded matter is cooled and solidified, it is pulverized and classified to obtain a desired particle diameter distribution. Other preparation methods include an atomization-drying method, a polymerization method and a micro-capsule method. The toner so obtained is sufficiently mixed with a suitable external additive by using a mixer such as a Henschel mixer, and the intended toner can be obtained finally.

In the developer used in the present invention, the exterior additive may be further added to the toner prepared as described above. The additive used hereby may be fundamentally those additives which are used customarily in this technical field. One suitable example of the additive is inorganic fine particles. The primary particle diameter of the inorganic fine particles is generally 0.005 to 2 $\mu$m and particularly preferably, 0.005 to 0.5 $\mu$m. The specific surface area of such inorganic fine particles is preferably within the range of 20 to 500 $m^2/g$ when it is measured by the BET method. The proportion of use of this inorganic fine particle is preferably within the range of 0.01 to 5.0 wt % on the basis of the total amount of the toner, and further preferably, within the range of 0.01 to 2.0 wt %. Concrete examples of suitable inorganic fine particles are metal salts of aliphatic acid, metal oxides such as silica, alumina (aluminum oxide), titanium oxide, barium titanate, magnesium titanate, calcium titanate, strontium titanate, zinc stearate, aluminum stearate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride.

Besides the exterior additives described above, it is possible to use polymeric fine particles, that is, fine particles of resins such as polystyrene and methacrylic esters and acrylic ester copolymers obtained by soap-free emulsion polymerization, suspension polymerization and dispersion polymerization, polymer particles obtained by polycondensation of silicone, benzoguanamine and nylon, and polymer particles of thermosetting resins.

Among the external additives described above, silica, titania and alumina fine particles, that are rendered hydrophobic, are particularly preferable. These fine particles will be explained more concretely. Examples of the silica fine particles include "HDK H 2000", "HDK H 2000/4", "HDK H 2050EP", "HVK 21" (trade names; all are products of Clariant Co.), "R972", "R974", "RX200", "RY200", "R202", "R805" and "R812" (trade names; all are products of Nippon Aerosil K.K.).

Examples of the titania fine particles are "P-25" (trade name; product of Nippon Aerosil K.K.), "STT-30" and "STT-65C-S" (trade names; products of Titan Kogyo K.K.), "TAF-140" (trade name; product of Fuji Titan Kogyo K.K.), and "MT150W", "MT-500B" and "MT-600B" (trade names; products of Teika K.K.).

Particularly, crystalline or amorphous, anatase-type and rutile-type titanium oxide can be used as the titanium oxide fine particles that are rendered hydrophobic. Such fine particles are available commercially under the following trade names: "T-805" (Nippon Aerojell K.K.), "MT100S", "MT-100T", "MT150A" and "MT150AFM" (Teika K.K.), "STT-30A" and "STT-65S-S" (Titan Kogyo K.K.), "TAF-500T" and "TAF-1500T" (Fuji Titan Kogyo K.K.), "MT-100S" and "MT100T" (Teika K.K.) and "IT-S" (Ishihara Sangyo K.K.).

The silica fine particles, the Tania fine particles or the alumina fine particles, that are rendered hydrophobic, can be prepared by treating hydrophilic fine particles with a silane coupling agent such as methyltrimethoxysilane, methyltriethoxysilane, octyltrimethoxysilane, or the like.

It is further effective to add a fluidizing agent (or a surfactant) to the exterior additives described above. Such a surfactant executes the surface treatment of the toner to improve hydrophobicity and can prevent deterioration of fluidization characteristics and charge characteristics even under a high moisture condition. Preferred examples of such surfactant include a silane coupling agent, a silylating agent, a silane coupling agent having a fluorinated alkyl group, an organotitanate type coupling agent, and an aluminum type coupling agent.

A cleaning property improving agent is also useful as an exterior additive. The cleaning property improving agent has the property of removing the developer remaining on the photosensitive drum and the primary transfer medium, that is, the function of improving the cleaning property. Suitable examples of such cleaning property improving agents include aliphatic metal salts such as zinc stearate, calcium stearate and sodium stearate, and polymer fine particles prepared by soap-free emulsion polymerization such as polymethyl methacrylate fine particles and polystyrene fine particles. The polymer fine particles used as the cleaning property improving agent has preferably a relatively narrow particle diameter distribution and a volume average particle diameter of 0.01 to 1 $\mu$m.

The present invention explained above provides the toner layer thickness-limiting blade that can restrict the thermal characteristics of the toner, can reduce the dust content of the fine toner particles, can be produced extremely easily by shaping the blade by using a flat sheet of the metal flexible member and chamfering the distal end of the blade, and can provide printing having high image quality and high reliability. The present invention provides the image formation apparatus using the blade. The image formation apparatus according to the present invention can be used especially advantageously for forming the color toner image.

Subsequently, the second and third image formation apparatuses according to the present invention will be explained. Incidentally, the first to third image formation apparatuses of the present invention are compatible to one another unless specified otherwise and unless the mode of operation and the effect of the present invention are affected adversely. Therefore, the explanation will be made in the simplified form, or will be omitted in some cases, to avoid repetition.

The second and third image formation apparatuses according to the present invention provide image formation apparatuses for the electrophotographic system that visualizes the electrostatic latent image by the developer, and forms the image. As described above, the image formation apparatus includes a developing device that comprises:

(1) a one-component developer stored in a developer container (toner hopper) defined by a casing;

(2) an image support capable of forming and holding an electrostatic latent image;

(3) a developer support capable of transferring the developer to a developing region on the image support, and so disposed as to oppose the image support while keeping contact with the image support;

(4) a developer feeding member capable of supplying the developer inside the developer container to the developer support, and so disposed as to be capable of moving while keeping flexible contact with the developer support; and (5) a thickness-limiting member for limiting the thickness of the developer on the developer support, supplied from the developer supplying member.

These constituent elements (1) to (5) of the developing device used in the present invention may have arbitrary compositions, arbitrary constructions and arbitrary shapes so long as they can satisfy the requirements of the present invention. These members may naturally be those members and devices which have been used customarily in known electrophotographic developing machines in general. The explanation will be given of these members, though it may partly overlap with the foregoing explanation.

The image support capable of forming and holding the electrostatic latent image is, for example, the basic constituent element of the image formation apparatus according to the present invention, and is typically a photosensitive drum, or the like.

The photosensitive drum, for example, uses an aluminum drum as its core metal, its surface is finished to a mirror surface, and a layer of a photosensitive material is deposited. The examples of the photosensitive materials and the deposition method are described already.

The developer support, that can transfer the developer to the developing region on the image support such as the photosensitive drum and is so disposed as to oppose the image support while keeping contact with the latter, is preferably made of an electric conductor, and is typically a developing roller, a developing sleeve, and the like.

The developer feeding member, that can supply the developer inside the developer container to the developer support and is to be so disposed as to be capable of moving while keeping flexible contact with the developer support, is preferably made of an electric conductor, and is typically a sponge roller or a fur brush.

The thickness-limiting member, that is used for limiting the thickness of the developer supplied from the developer feeding member to the developer support, is typically a thickness-limiting blade. To limit the thickness of the developer allowed to adhere to the developer support in the thin film form to a uniform thickness, the thickness-limiting blade can be formed of various flexible materials into different shapes. Examples of the thickness-limiting blade include a flexible rubber, a stainless steel sheet and a leaf spring. These materials can be shaped into the shape capable of easily scraping off the toner (for example, into a tongue shape, a spatula-like shape, etc). The afore-mentioned thickness-limiting blade can be used advantageously.

In addition to the typical constituent elements described above, the developing device used in the present invention may further include a toner agitation mechanism, a toner density control mechanism, a toner supplementation mechanism and a development bias control mechanism, for example. These mechanisms are well known to those skilled in the art, as explained already.

Besides the developing device described above, the image formation apparatus according to the present invention includes known devices necessary for executing the electrophotographic process, such as a charging device, an exposing device, a transferring device, a cleaning device, a de-charging device and a fixing device. These devices, too, are well known to those skilled in the art.

The developer (toner) used for visualizing the electrostatic latent image in the present invention is a nonmagnetic one-component developer. The nonmagnetic one-component developer does not need to use a carrier in combination. Therefore, it provides the advantage that mixing and stirring means of the toner are not necessary, hence the developing device can be rendered compact in size and moreover, a magnetic material need not be mixed with the toner. Since this developer provides high transparency and can form a thin toner film, it can exhibit its effects in the formation of a full-color image. This one-component system developer can basically have the same construction as the one-component developer that has been used ordinarily in the art. Therefore, it can be prepared by the same method as the conventional methods. For the detail of the one-component developer that can be used hereby, reference is to be made to the foregoing explanation.

The mean particle diameter of the toner and its particle size distribution can be measured by various customary methods. For example, the mean particle diameter of the toner and its particle size distribution can be measured by using a Coaltar Counter YA-II or a Coaltar Multisizer (both being products of Coaltar Co.). The present invention conducts the measurement by using particularly a Multisizer Type II (product of Coaltar Co.) and an Interface (product of Nikka K.K.) for outputting the particle number distribution and a volume distribution while a PC9801 personal computer (product of NEC) is connected to them. A 1% aqueous NaCl solution prepared from primary sodium chloride is used for an electrolyte. Incidentally, ISOTON-II (product of Coaltar Scientific Japan Co.) can be used for the same purpose, though the present invention does not use this equipment. To conduct the measurement, 0.1 to 5 ml of a surfactant as a dispersant, preferably an alkylbenzenesulfonate, is added to 100 to 150 ml of the aqueous electrolyte solution, and 2 to 20 mg of the measurement sample is further added. Next, the electrolyte suspending the measurement sample is subjected to dispersion treatment inside a ultrasonic disperser for about 1 to about 3 minutes, and a 100 $\mu$m aperture is used as the aperture by the Multisizer Type II. The volume distribution and the number distribution are calculated by measuring the volume and number of the toner particles exceeding 2 $\mu$m. Next, the volume average particle diameter on the volume basis determined from the volume distribution, the coarse powder amount (12.7 $\mu$m or above) on the volume basis determined from the volume distribution and the fine powder amount (5 $\mu$m or below) on the number basis determined from the number distribution are calculated.

Next, an application example of the second and third image formation apparatuses of the present invention to an electrophotographic printer will be explained with reference to the drawings. Needless to say, the image formation apparatus of the present invention is not particularly limited to this example.

Figure 17:
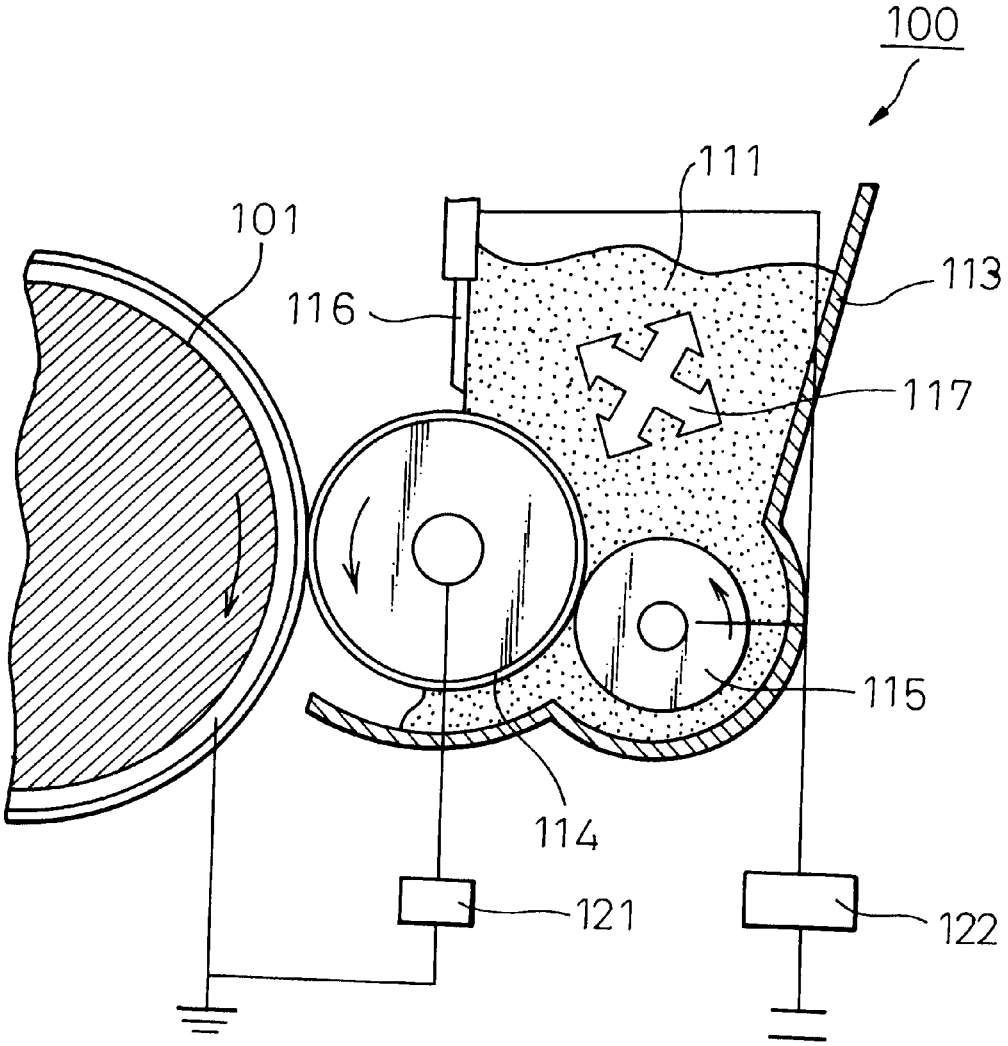
FIG. 17 is a sectional view showing the construction of a developing device used in an image formation apparatus according to a preferred embodiment 1 of the present invention.

FIG. 17 is a sectional view showing schematically the construction of the developing device assembled into the image formation apparatus of the present invention. A photosensitive drum 101 as the image support can rotate at a peripheral speed of 60 mm/sec in the direction indicated by arrow (clockwise). The developing device 100 is disposed on the right side of the photosensitive drum 101 as shown in the drawing. Known devices necessary for executing the electrophotographic process, such as a charging device, an exposing device, a transferring device, a cleaning device, a de-charging device and a fixing device, are disposed round the photosensitive drum 101. Since these devices are well known in the image formation apparatuses based on the electrophotographic process, the explanation will be hereby omitted.

The developing device 100 includes a casing 113 having an opening that faces the surface of the photosensitive drum 101; a developing roller 114 as a developer support that can rotate at a predetermined peripheral speed in the direction of arrow (counter-clockwise) while a part thereof is exposed from the opening of the casing 113; a sponge roller 115 as a developer feeding member that is disposed on the right side of the developing roller 114 and can rotate in the direction of arrow (counter-clockwise) while keeping the pressure-contact state with the developing roller 114; an agitator 117 that supplies a nonmagnetic one-component developer (hereinafter called the "toner") 111 stored in a hopper portion (also called the "development container") as developer storage means formed on the right side inside the casing 113, and agitates the toner inside the hopper portion; and a toner thickness-limiting blade (generally called the "doctor blade") 116 as a thickness-limiting member for making uniform the thickness of the toner layer on the developing roller 114 that is transferred to a developing region as an opposing portion to the photosensitive drum 101 by the revolution of the developing roller 114.

As shown in FIG. 17, the developing roller 114 may be so disposed as to oppose the surface of the photosensitive drum 110 in the developing region with a predetermined gap, and to execute non-contact development. Alternatively, it may be disposed in such a fashion that the toner layer on the developing roller 114 comes into contact with the surface of the photosensitive drum 101, and contact development can be made. However, when development is conducted by complete equal-speed development in contact development, physical adhesion of the toner is likely to occur irrespective of the surface potential of the photosensitive drum 101 because no speed difference exists between the surface of the photosensitive drum 101 and the surface of the developing roller 114. To avoid this problem, the peripheral speed of the developing roller 114 is preferably set to a speed somewhat higher than that of the photosensitive drum 101. The peripheral speed ratio (peripheral speed of photosensitive drum: peripheral speed of developing roller) is preferably within the range of 1:1.1 to 1:1.5, for example.

A suitable development bias voltage such as DC, AC, DC-superposed AC, or a pulse voltage is applied from a bias power source 121 to the developing roller 114. In the case of the non-contact development, in particular, a voltage having a DC component enabling good flying of toner (AC, DC-superposed AC or pulse voltage) is applied preferably. Incidentally, this example uses an developing roller 114 comprising an electrically conductive rubber roller and having a resistance of $10^5$ to $10^8$ $\Omega$ in terms of an axis-to-surface resistance.

The sponge roller 115 is equipped with a flexible foamed layer on the core metal. A large number of voids are open in the elastic foamed layer, at least in proximity to its surface, so that the toner can be held inside these voids. The material of the flexible foamed layer of the sponge roller 115 for supplying the toner is preferably the one that has a frictional charge coefficient in between the frictional charge coefficient of the material of the toner 114 and that of the material of the surface portion of the developing roller in the frictional charge system so that it can come into contact with the developing roller 114 and can impart a desired frictional charge to the developing roller 114. Incidentally, the sponge roller 115 is supported at the position, for example, where into comes into the developing roller 114 in a predetermined depth from the roller surface and comes into pressure contact with the development roller 114. The sponge roller 114 is driven and rotated in the normal direction so that it can move in the same direction as the surface of the developing roller 114 at the contact portion with the developing roller 114. The linear velocity of the sponge roller is set to a value that is 0.9 to 1.1 of the linear velocity of the developing roller 114 and preferably, to the same linear velocity. This is to prevent degradation of the toner resulting from the mechanical friction. When the linear velocities are the same, degradation of the toner can be reduced to minimum. The diameter of the sponge roller 115 is smaller than that of the developing roller 114 to reduce the nip width and to minimize the mechanical friction. In consequence, degradation of the toner can be further reduced.

A voltage equivalent to the voltage applied from the bias voltage source 122 to the developing roller 114, or a voltage capable of forming, with the developing roller 114, an electric field that imparts electrostatic force to the toner charged frictionally to a predetermined polarity in the direction from the side of the toner feeding roller 115 to the side of the developing roller 114, may be applied to the core metal of the sponge roller 115, too.

The agitator 114 supplies the toner 111 stored in the hopper portion to the surface of the sponge roller 115 and agitates also the stored toner 111. However, the agitator 114 may be omitted when the toner can be supplied by its own weight to the surface of the sponge roller 115 depending on the shape of the hopper portion or on the fluidity of the toner.

The doctor blade 116 is disposed in such a manner as to come into contact with the developing roller 114 with a contact pressure of about 500 to about 1,500 g/cm in the case of contact development. In the case of non-contact development, the doctor blade 116 is so disposed as to come into gentle contact with the developing roller 114 with a contact pressure that is about 50% of the contact pressure of contact development.

The present invention explained above provides a developing device having the following features. The developing device has long-term stability without inviting deterioration of the toner, hence deterioration of image quality, and without increasing the mechanical torque. The developing device is free from a negative after-image resulting from insufficiency of the toner amount supplied from the sponge roller cycle, photographic fog due to non-uniformity of the toner charge quantity resulting from insufficiency of frictional charging of the toner, deterioration of the development shift, and a positive after-image due to the developing roller cycle resulting from the toner selective development. The present invention can therefore provide an excellent image formation apparatus. Particularly, the present invention provides further effects in a color image formation apparatus in which colors are visualized through toners such as a color image and eventually, a color image formation apparatus using a luster toner in which the toner adhesion amount and the density have a linear relationship.

EXAMPLES

Subsequently, the present invention will be explained about its examples, that are merely illustrative, and not restrictive, examples.

Measurement of Glass Transition Point (Tg)

The glass transition point Tg (° C.) of the toner was measured in the following way by using "DSC-200" of Seiko Instruments Co.

1. The sample was pulverized, and 10±1 mg was placed into an aluminum sample case. An aluminum cover was put from above.

2. The glass transition point (Tg) was measured in accordance with a DSC process in a nitrogen atmosphere.

Here, the sample was heated from room temperature to 150° C. at a rate of 20° C./min, and was left standing at 150° C. for 10 minutes. This sample was then cooled to 0° C. at a rate of 50° C./min and was left standing at 0° C. for 10 minutes. It was again heated to 150° C. at a rate of 20° C./min in a nitrogen atmosphere (nitrogen flow rate=20 ml/min). The DSC measurement was conducted after heating was completed.

Measurement of Weight Average Particle Diameter and Particle Diameter Distribution The weight average particle diameter of each toner and the particle diameter distribution were measured by using a Coaltar counter TA II of Coaltar Co. at an aperture diameter of 100 $\mu$m.

EXAMPLE 1

Preparation of Toners A to G (1) Preparation of toner A

| | |
|---|---|
| styrene-butyl acrylate copolymer (styrene/n-BA = 82/18, Mn = 7,400 Mw/Mn = 39, Tg = 63° C.) | 85 parts by weight |
| Carbon Black (MA60, product of Mitsubishi Chemicals, Co.) | 10 parts by weight |
| Cr-containing azo dye (Bontron S34, Orient Kagaku K.K.) | 3 parts by weight |
| carnauba wax (ester wax, melting point = approx. 82° C.) | 2 parts by weight |

After being mixed by a mixer, these materials were melt-kneaded by a biaxial extrusion-kneader, and the resulting kneaded matter was rolled and cooled. Thereafter, the kneaded matter was pulverized and classified to give a toner having a weight average particle diameter of 9.1 $\mu$m. Next, 0.5 wt % of hydrophobic silica (HDK 2000H, product of Clariant Co.) was added to the resulting toner and mixed by using a mixer. The glass transition point Tg of the toner A thus obtained was 62° C., and the dust amount having a weight average particle diameter of below 5 $\mu$m was 16 number %.

(2) Preparation of toner B

| | |
|---|---|
| polyester resin 1 (acid value = 5, Mn = 4,500, Mw/Mn = 4.0, Tg = 65° C.) | 700 parts by weight |
| Blue pigment (LIONOL BLUE FG-7351, product of Toyo Ink K.K.) | 300 parts by weight |

The materials were sufficiently mixed by using a Henschel mixer and were subjected to 3-pass kneading using triple rolls. After kneading was completed, the resulting kneaded matter was cooled and pulverized by a pulverizer. There was thus obtained a master batch pigment used for the toner preparation of the next step.

| | |
|---|---|
| polyester resin 2 (acid value = 5, Mn = 45,000, Mw/Mn = 4.0, Tg = 60° C.) | 100 parts by weight |
| master batch pigment (prepared as described above) | 10 parts by weight |
| zinc salicylate (Bontron E84, product of Orient Kagaku K.K.) | 4 parts by weight |

The materials described above were melt-kneaded by using a biaxial kneader, and the resulting kneaded matter was rolled and cooled. The kneaded matter was then pulverized and classified, and a toner having a volume mean particle diameter of 8.4 μm was obtained. Next, 0.5 wt % of hydrophobic silica (HDK 2000H, product of Clariant Co.) was added to the resulting toner and was mixed with a mixer. Tg of the toner B so obtained was 59° C., and the dust amount having a weight average particle diameter of 5 μm or below was 12 number %.

(3) Preparation of toner C

The preparation of the toner A was repeated by changing in this case the preparation condition so that the weight average particle diameter was 11.5 μm and the dust amount of particles of 5 μm or below was 11 number %. The resulting toner was called the "toner C".

(4) Preparation of toner D

The preparation of the toner A described above was repeated by changing in this case the preparation condition so that the weight average particle diameter became 7.3 μm and the dust amount of 5 μm or below became 23 number %. The resulting toner was called the "toner D".

(5) Preparation of toner E

The preparation of the toner A was repeated by changing in this case the preparation condition so that the weight average particle diameter became 5.7 μm and the dust amount of particle diameters of 5 μm or below became 19 number %. The resulting toner is called the "toner E".

(6) Preparation of toner F

The preparation of the toner B was repeated by using in this case the same amount of the polyester resin 3 (Mn=4, 700, Mw/Mn=2.4, Tg=54° C.) in place of the polyester resin 1. Tg of the toner so obtained was 54° C., the weight average particle diameter was 8.6 μm and the dust amount having a weight average particle diameter of 5 μm or below was 9 number %.

(7) Preparation of toner G

The preparation of the toner B was repeated by using in this case the same amount of the polyester resin 4 (Mn=6, 100, Mw/Mn=7.6, Tg=71° C.) in place of the polyester resin 1. Tg of the toner G obtained was 71° C., the weight average particle diameter was 8.5 μμm, and the dust amount having a weight average particle diameter of 5 μm or below was 8 number %.

EXAMPLE 2

Toner Evaluation Test (1)

Each of the toners A to G prepared in Example 1 described above was charged into the image formation apparatus explained with reference to FIG. 10, and printing quality, transmissivity of OHP and the occurrence of white stripes (occurrence of blade fusing) were evaluated by a visual inspection. Incidentally, the toner layer thickness-limiting blade of the nonmagnetic one-component developing device used in this example was made of a flat sheet-like stainless steel for spring that was chamfered at its distal end. The shape was the same as that of the blade explained already with reference to FIG. 7. Table 1 illustrates the result of the evaluation test.

TABLE 1

| toner | printing quality | OHP transmissibility | white stripe (blade fusing) |
|---|---|---|---|
| A | ○ | ○ | ○ |
| B | ○ | ○ | ○ |
| C | X*1 | ○ | ○ |
| D | ○ | ○ | X |
| E | ○ | ○ | X |
| F | ○ | ○ | X |
| G | ○ | X | ○ |

*1: Character/thin line became thick.
○: permissible by visual inspection
X: not permissible by visual inspection

Toner Evaluation Test (2)

Figure 14:
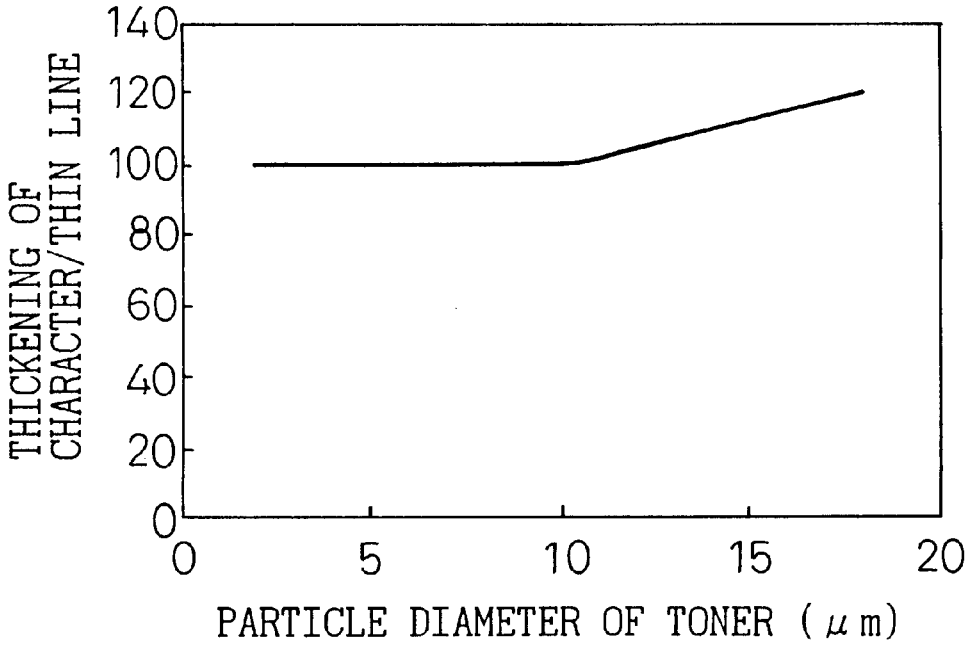
FIG. 14 is a graph showing the relationship between a particle diameter of a toner and thickening of character/thin line.

When the relationship between the toner particle diameter and thickening of character/thin line was examined for the toner C prepared in Example 1, the result plotted in FIG. 14 was obtained. It can be seen from the graph that thickening of the character/thin line occurred when the toner particle diameter was greater than 10 μm.

Toner Evaluation Test (3)

Figure 15:
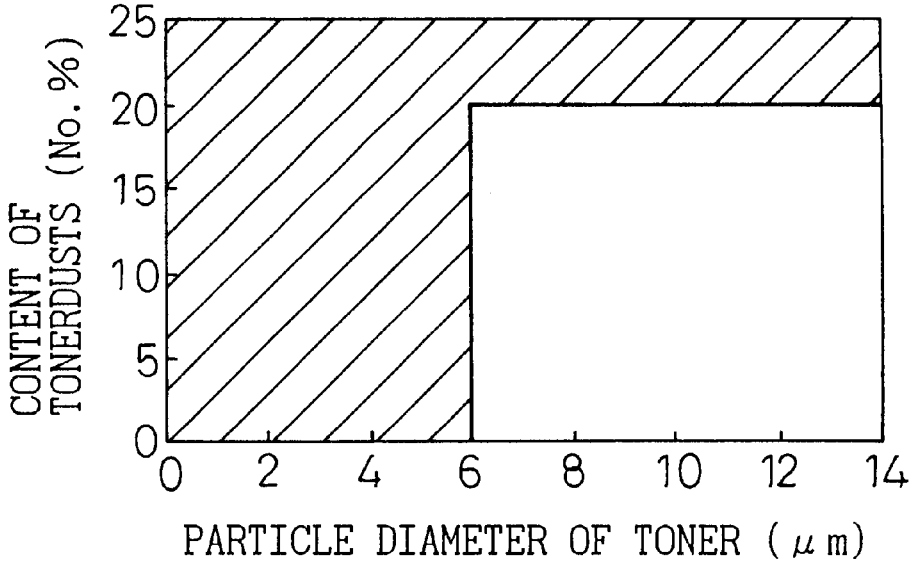
FIG. 15 is a graph showing the relationship between a particle diameter of a toner and a toner dust content in connection with a blade fusion occurrence region.

When the relationship between the toner particle diameter and the toner dust amount was examined for the toners D and E prepared in Example 1, the results plotted in FIG. 15 could be obtained. Fusing of the blade occurred at the portion of oblique lines in the graph. It was found that when these toners were used, the toner fused to the blade and "white stripes" occurred. Toner evaluation test (4)

Figure 16:
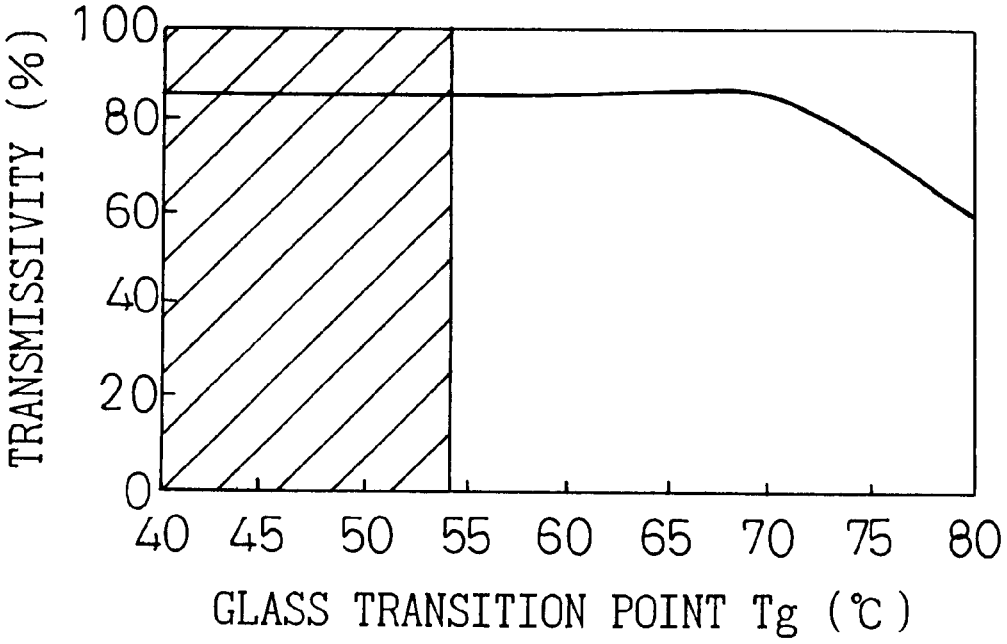
FIG. 16 is a graph showing the relationship between a glass transition point of the toner and transmissivity in connection with a blade fusion occurrence region.

When the relationship between the glass transition point of the toners and transmissivity was examined for the toners F and G prepared in Example 1, the result plotted in FIG. 16 was obtained. Fusing of the blade occurred in the portion of oblique lines in the graph. It was found that when these toners were used, the toner fused to the blade and "white stripes" occurred and at the same time, transmissivity of an OHP was low.

EXAMPLE 3

The image formation apparatus shown in FIG. 17 and described above was produced. The detail of the devices such as the developing roller was as follows.

(1) Developing roller

The developing roller was produced by lining the surface of a core metal roller having a diameter of 10 mm with a conductive NBR rubber layer, and coating a urethane coating layer having a thickness of dozens of microns on the surface. It had an outer diameter of 18 mm. The surface-to-surface resistance of this developing roller was from $1\times10^3$ Ω to $1\times10^8$ Ω and preferably, $1\times10^4$ Ω to $1\times10^7$ Ω.

(2) Sponge roller

The sponge roller comprised a sponge roller having a conductive flexible foamed body layer on a core metal roller of a diameter of 8 mm, and had a diameter of 14 mm. The sponge roller was brought into contact with the developing roller with a catching depth of 0.4 mm. The sponge roller was rotated in counter-rotation at the same linear velocity as that of the developing roller. The conductive flexible foamed body layer of this sponge roller used a foamed silicone formed by adding 10 mass % of carbon, and then causing foaming and shaping. The resistance of the sponge roller used in this example fell within the range of $1\times10^2$ Ω to $1\times10^{11}$ Ω.

(3) Doctor blade

A stainless steel leaf spring (SUS304) having a thickness of 0.1 mm was disposed so that its edge portion spaced by a free length of 16 mm from a supporting point came into pressure contact with the developing roller at a contact pressure of 500 to 1,500 g/cm.

(4) Developing bias (bias power source)

A−300 V DC voltage was applied to the developing roller, and a catching depth with the photosensitive drum was set to 30 to 60 μm.

(5) Sponge roller, doctor blade bias (bias power source)

A bias voltage, that had the same polarity as the DC component of the developing bias and an absolute value greater by 100 V than that of the developing bias, such as −400 V DC bias when the DC component of the developing bias was −300 V, was applied to the core metal of the sponge roller. A bias voltage of the same voltage value as that of the sponge roller was applied to the doctor blade, too.

(6) Photosensitive drum

The photosensitive drum was uniformly charged by using OPC. The latent image reached −600±50 V at the primer portion and −100±50 V at the write portion (image portion).

(7) Toner

A negative charge toner using a nonmagnetic polyester type resin was prepared in the following way and was used. The particle diameter of the toner fell within the range of 6 to 10 μm in terms of the number average.

[Toner composition]

| | |
|---|---|
| polyester resin (acid value = 3, hydroxyl group = 25, Mn = 45,000, Mw/Mn = 10.0, Tg = 65° C.) | 100 parts by weight |
| Phthalocyanine Green | 2 parts by weight |
| carbon black (MA60, product of Mitsubishi Kagaku K.K.) | 10 parts by weight |
| charge controller (containing chromium monoazo dye) | 2 parts by weight |

[Preparation procedure]

After the toner materials described above were mixed by using a mixer, the mixture was melt-kneaded by a twin-roller mill, and the resulting kneaded matter was rolled and cooled. Thereafter, pulverization by using a collision plate system pulverizer using a jet mill (Type I mill, product of Nippon Pneumatic Kogyo K.K.) and wind power classification by using a turning flow (DS Classifier; product of Nippon Pneumatic Kogyo K.K.) were carried out to obtain colored particles. Furthermore, 0.5 mass% of hydrophobic silica ("H2000", product of Clariant Japan Co.) was added and was mixed by using a mixer.

EXAMPLE 4

Toners A, B, C, D, E, F, G and H having various particle diameter distributions as summarized in Table 2 below were prepared in accordance with the toner preparation procedure described above. To prepare these different toners, the pressure at the time of pulverization and the turning speed by the adjustment of the gap of the air inlet at the time of classification were changed. The mixing recipe of the toner materials and hydrophobic silica as the external additive was the same for all the toners. The volume average particle diameter and the particle diameter distribution were the actually measured values by using a Multisizer II at an aperture diameter of 100 μm.

The degree of the positive after-image of each toner was compared with the result tabulated in Table 2.

TABLE 2

| toner | volume average particle size (μm) | dust content (%) | coarse particle content (%) | positive after-image |
|---|---|---|---|---|
| A | 8.5 | 8.2 | 1.5 | 0.05 |
| B | 8.3 | 25.3 | 1.2 | 0.16 |
| c | 8.6 | 7.9 | 2.8 | 0.12 |
| D | 8.5 | 28.2 | 2.6 | 0.18 |
| E | 6.9 | 16.2 | 0.8 | 0.03 |
| F | 6.7 | 28.6 | 0.6 | 0.09 |
| G | 7.1 | 15.3 | 2.3 | 0.16 |
| H | 7.0 | 26.9 | 2.5 | 0.18 |

The positive after-image shown in Table 2 was measured in the following procedure. In this example, the negative after-image was also measured in addition to the positive after-image.

Figure 18:
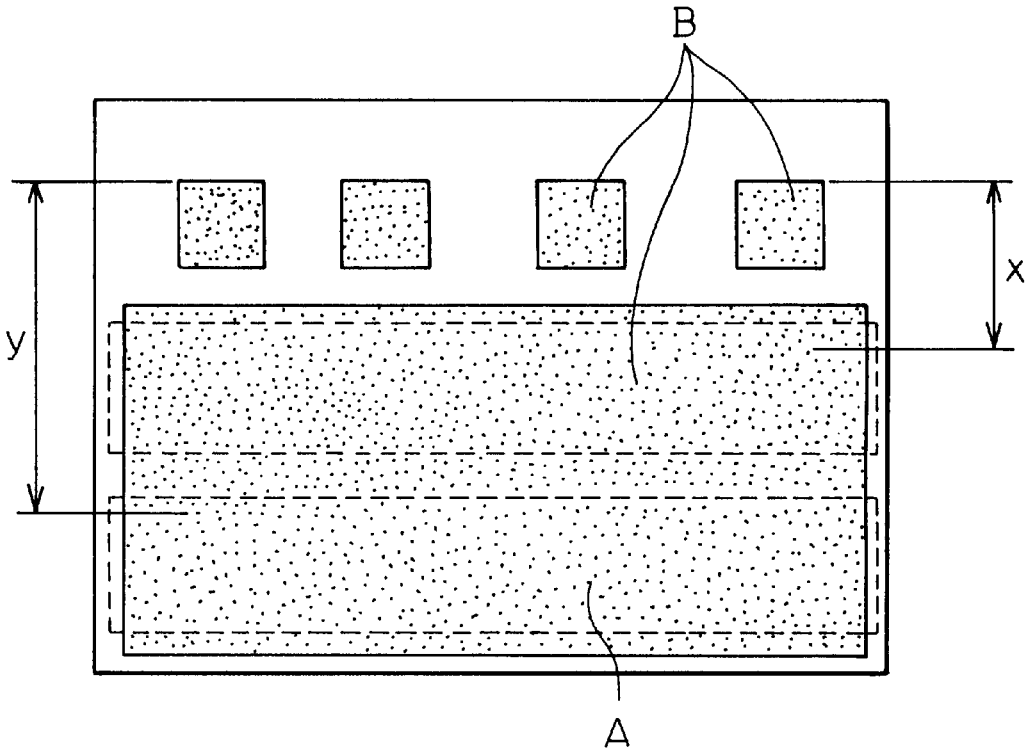
FIG. 18 is a graph showing an evaluation pattern of a negative after-image and a positive after-image.

First, the evaluation of the negative after-image was explained. A printing pattern (comprising the combination of the areas A and B) showing in FIG. 18 was printed, and the printing density ODa of the area A in which the negative after-image of the reset roller cycle occurred and the normal density ODn around the former were measured by using an optical densitometer X-rite 938 (product of X-rite Co.). The mean value of their density difference ΔOD (ODn−ODa) at four positions was used as the evaluation scale of the negative after-image. In the drawing, x represented the developing roller cycle component and y did the developing roller+sponge roller cycle component. The occurrence area A corresponded to the portion from the positions of the four patch patterns at the leading part of printing to the positions of 1 cycle of the developing roller +1 cycle of the reset roller. It could be appreciated that the greater this density difference, the more remarkable became the occurrence of the negative after-image. When inspected by a visual inspection, the after-image could not be identified when the density difference was 0.1 or below, and could hardly be identified when the density difference was 0.07 or below. Therefore, the density difference that gave the good condition was judged as being 0.1 or below and preferably, 0.07 or below.

In the case of evaluation of the positive after-image, too, the printing pattern was printed and used for the measurement in the same way as in the evaluation of the negative after-image. The density ODb of the area B in which the positive after-image occurred and the normal density ODn round the former were measured by using an optical densitometer X-rite (product of X-rite Co.), and the mean value of their density differences ΔOD(ODb−ODn) at four positions was used as the evaluation scale of the positive after-image. The occurrence area B corresponded to the portion from the positions of four patch patterns at the leading part of printing to the positions of one cycle of the developing roller. It was judged that the greater the density difference, the more remarkable became the occurrence of the positive after-image. When inspected by the visual inspection, the after-image could not be identified easily at the density difference of 0.1 or below, and could hardly be identified when the density difference is 0.07 or below. Therefore, the density difference that gave the good condition was judged as being 0.1 or below and preferably, 0.07 or below.

As a result, it was found that, with the toners A and H in which the proportions of the dust and coarse powder were limited, the occurrence of the positive after-image could be restricted even at different volume average particle diameters.

As described above, the studies of the present inventors revealed that the toners were consumed selectively from the toner having a smaller particle diameter in the one-component development method. Therefore, the smaller the toner particle diameter, the more difficult became the occurrence of the selective supply phenomenon, and the more difficult became of the occurrence of the positive after-image, too. It was obvious that a smaller amount of the coarse powder toner, that could not be supplied so easily selectively, functioned more advantageously for reducing the positive after-image. In this way, the particle diameter distribution, in which the proportion of the dust was small and moreover, the proportion of the coarse powder was small, too, or in other words, the toner having a sharp particle diameter distribution, was overwhelmingly advantageous for reducing the positive after-image. This example made it possible to prevent the easy occurrence of the positive after-image by visually inspecting in advance the volume particle diameters. More concretely, the particle diameter distribution of the toner was set to 6 to 10 m, the proportion of the particles of 5 m or below was from 0 to 20 number % and the proportion of the particles of 12.7 or more was set to from 0 to 2.0 vol %.

It was found that when the particle diameter distribution satisfied the condition described above, it was effective for reducing the positive after-image at the developing roller peripheral speed even under the severe condition where the linear velocity of the sponge roller was set to a speed equal to that of the developing roller.

EXAMPLE 5

The shaft-to-surface resistance Rd of the developing roller and the surface-to-surface resistance Rr of the sponge roller were changed by using the toners A and H prepared in Example 4 described above.

Figure 19:
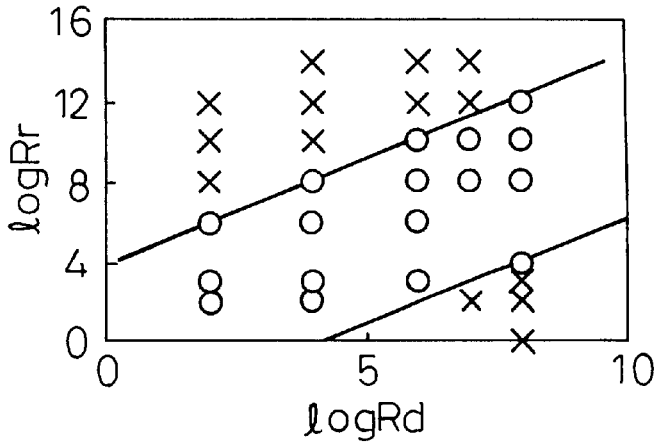
FIG. 19 is a graph showing the relationship between the resistance of a developing roller and a sponge roller and a positive after-image occurrence distribution.

FIG. 19 shows the occurrence area of the positive after-image. The abscissa represented logRd and the ordinate did logRd. In the graph, white circles ○ represent "no positive after-image" and X represents "positive after-image exists". It can be seen that an excellent result could be obtained without the occurrence of the positive after-image at $-4 \leqq \log(Rd/Rr) < 4$ ($\log(Rd/Rr) \neq 0$). Though the reason why such a good result could be obtained has not yet been clarified, it is assumed that the smaller the difference in the resistance, the smaller became of the flow of the current between the rollers, so that an unnecessary current was prevented from being applied to the toner. Therefore, the toner could collect the charge merely through charging by pure friction, and non-uniformity of the charge inherent to the toner decreased. In consequence, the selective supply could be presumably reduced.

EXAMPLE 6

It was believed that the negative after-image of the sponge roller cycle occurred when charging of the toner was insufficient. For an analytical purpose, therefore, various toners were prepared with recipes that lowered the toner charge. To analyze the positive after-image, too, the toners were prepared also under the condition that increased the toner charge. More concretely, toners I, J, K and L, that had the same particle diameter distribution as the toner A but had various different amounts of the charge controller (Cr-containing monoazo dye) were prepared as tabulated in Table 3. This table also illustrates the charge amount on the sleeve and the rise value of the charge amount on the sleeve.

TABLE 3

| toner | amount of charge controller (parts by weight) | Q/M on sleeve ($\mu$C/g) | Q/M rise value on sleeve ($\mu$C/g) |
|---|---|---|---|
| A | 2 | −45 | −38 |
| I | 1 | −43 | −27 |
| J | 0.5 | −37 | −15 |
| K | 4 | −59 | −48 |
| L | 5 | −61 | −48 |

The charge amounts of the toners tabulated in Table 3 were measured by the blow-off method for measuring the charge amount of a two-component developer. After the charge amount of each toner was confirmed, the change amount q/m of the toner layer on the developing roller was calculated from the toner layer potential $V_t$ and the toner layer thickness $d_t$ by the following equation:

$$q/m = 2\epsilon^o \epsilon_{r1} Vt/(\rho P d_t^2)$$

where $\epsilon_o$: dielectric constant of vacuum ($8.85\times10^{-12}$ F/m)

$\epsilon_{r1}$: specific dielectric constant of toner layer (2.2)

$\rho$: toner density (1.1 g/cm$^3$)

P: packaging ratio of toner layer (constant: assumed as 0.45)

$V_t$: toner layer potential (variable)

$d_t$: toner layer thickness (variable)

The potential of the toner layer was measured by using a surface potentiometer ("Model 344", product of Treck Co.). The layer thickness of the toner layer was measured by using the difference of the thickness of the toner layers before and after the suction-removal of the toner layer by using a laser dimension meter ("LS-5000", product of Keyensce K.K.) as the actual measurement value. Since the toner layer thickness was different between immediately after printing and after lapse of the time, the measurement was conducted after printing of one black solid printing and three white solid printing so as to always insure a constant condition of the thickness. Also, the condition was set so that the measuring point of the toner layer potential and the toner layer thickness became the same.

Figure 20:
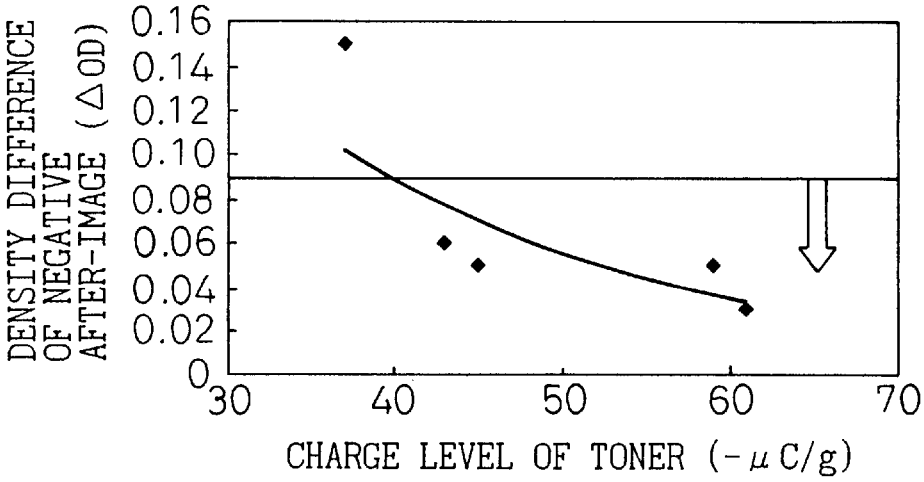
FIG. 20 is a graph showing the relationship between a toner charge quantity on a developing roller and a density difference due to negative after-image.
Figure 21:
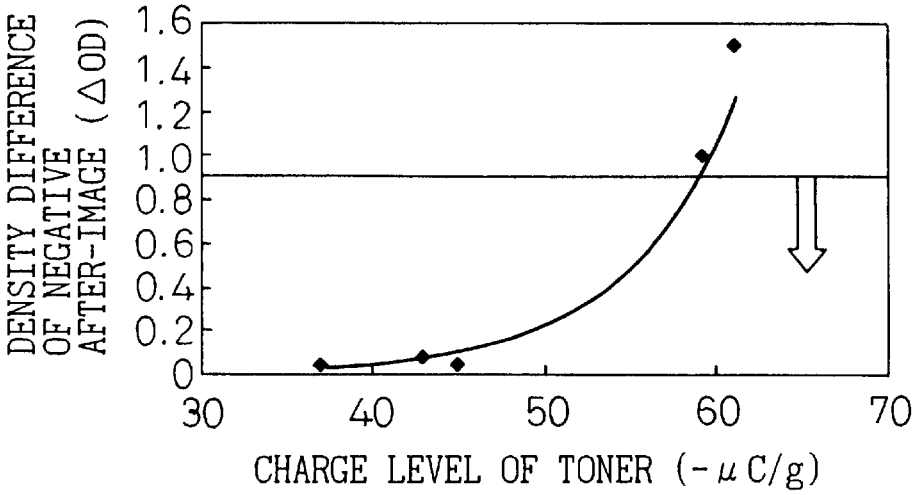
FIG. 21 is a graph showing a toner charge quantity on a developing roller and a density difference due to a positive after-image.

As a result, it was clarified that the higher the charge amount of the toner, the more difficult it became for the negative after-image to occur, and the negative after-image did not occur when the toner charge amount was −40 $\mu$C/g or more (see the toners A and I, and FIG. 20).

The occurrence of the positive after-image was examined similarly by using the same toner. It was found that the positive after-image did not occur when the charge amount was −60 $\mu$C/g or below, on the contrary. It was thus clarified that the region in which both negative and positive after-images did not occur was from −40 to −60 $\mu$C/g, and when this condition was satisfied, both negative and positive after-images did not occur.

In conjunction with the negative after-image of the sponge roller cycle, better conditions could of course be obtained when the toner was charged up to the charge amount described above during the period from the point at which the sponge roller supplied the toner to the developing roller to the point at which a new toner was supplied, in consideration of the mechanism of negative after-image occurrence.

EXAMPLE 7

The toner A was prepared in the same way as in Example 4 with the exception in this case that the same amount of a polyester resin having an acid value=3, a hydroxyl group value=25, Mn=12,000, Mw/Mn=2.8 and Tg=62° C. as a binder resin in place of the polyester resin used for the toner. There was thus obtained a toner capable of generating luster (hereinafter called "lustrous toner") M. Incidentally, the particle diameter distribution and the external addition condition were the same as that of the toner not exhibiting luster (hereinafter called the "non-lustrous toner) A.

Figure 22:
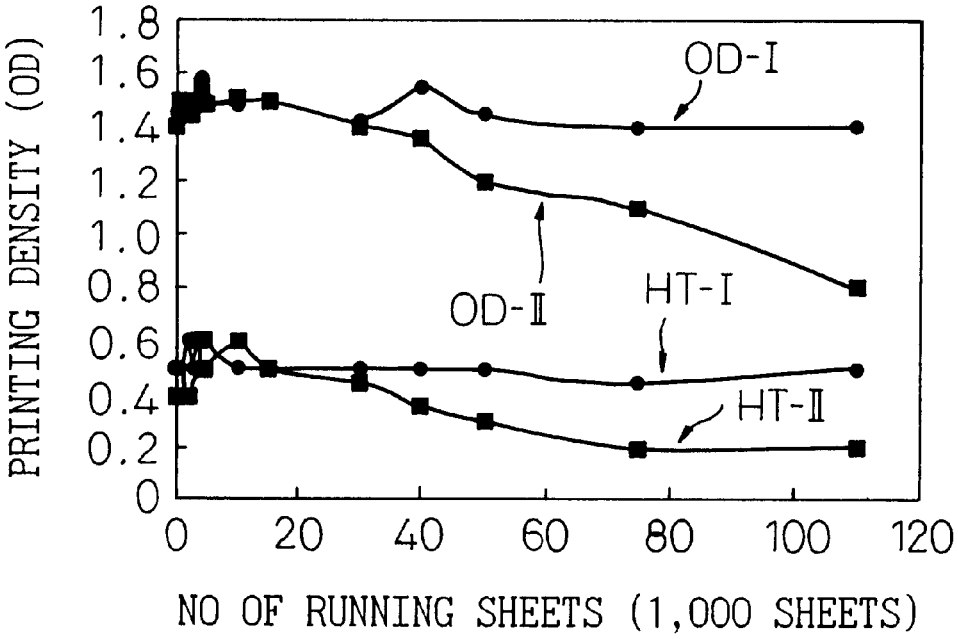
FIG. 22 is a graph showing the relationship between a running number of sheets and a printing density (image quality)

When the viscosity of the resulting toners were measured, the viscosity was 53,000 Pasec at 100° C. for the non-lustrous toner A and was 13,000 Pasec at 100° C. for the lustrous toner M. Incidentally, these viscosities were the values calculated from the outflow velocity measured when each toner was molded by an exclusive molding device of a flow tester (product of Shimazu Seisakusho K.K.) and the resulting molded article was heated at a rate of 3° C./min using a die having a diameter of 1 mm (thickness of 0.5 mm) at a 20 kg load. A durability test was conducted in the developing device produced in Example 3 while white sheets of paper were continuously run. The test result was compared with the conventional direction. As a result, the toner of the present invention could achieve as increase of life to about 2.7 times, as shown in FIG. 22. In FIG. 22, OD-1 represents the printing density of the example of the present invention, OD-II represents the printing density of the prior art example, HT-1 represents the half-tone density of the example of the present invention, and HT-II represents the half-tone density of the prior art example.

In the prior art condition for comparison, the linear velocity of the sponge roller was set to counter-rotation relative to the developing roller and to a speed 2.5 times that of the developing roller. The electric resistance was $1\times10^{10}$ Ω, and all the other conditions were the same.

The electric resistance of the developing roller was $1\times10^{5}$ Ω, and all the other conditions remained the same. The other conditions of the developing device and the conditions for forming the image were all the same.

Figure 23:
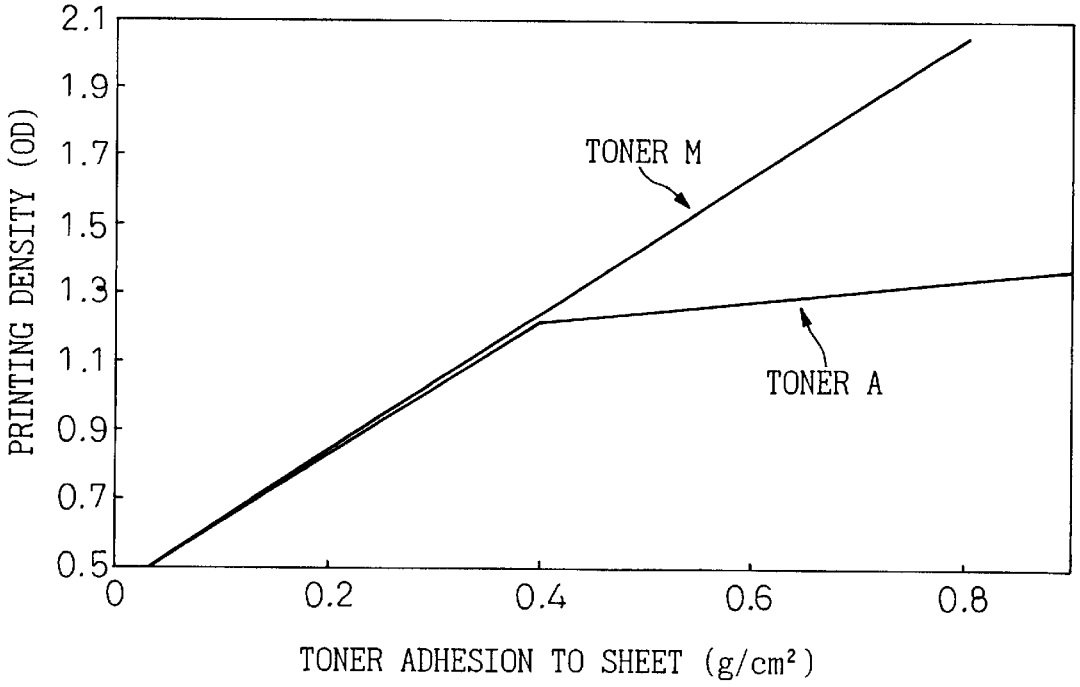
FIG. 23 is a graph showing the relationship between an adhesion quantity of a lustrous toner and a non-lustrous toner on a sheet, and a printing density.

Next, the relationship between the toner adhesion amount to the sheet and the printing density was measured when the lustrous toner M prepared in this example was used. The result was shown in FIG. 23. As shown in FIG. 23, the toner M had a linear relation even under the conditions where the toner adhesion amount was large. In comparison with the non-lustrous toner A in which the image defects such as the negative after-image and the positive after-image appeared more remarkably due to the difference of the toner adhesion amounts, the lustrous toner M provided obviously greater effects.

What is claimed is:

1. An image formation method for forming a color image by using a contact type nonmagnetic one-component developing device in accordance with an electrophotographic process, characterized in that, inside said developing device, a flat sheet-like blade made of a metal flexible member and having a distal end thereof chamfered is used as a toner layer thickness-limiting blade, and a toner having a glass transition point of 55 to 70° C., a weight average particle diameter of 6.0 to 10.0 μm, and containing up to 20 number % of particles having particle diameters of 5 μm or below, is used as a developer.

2. An image formation method according to claim 1, wherein said chamfered portion of said toner layer thickness-limiting blade is further polished.

3. An image formation method according to claim 1, wherein said toner layer thickness-limiting blade is made from a flat sheet-like stainless steel for springs.

4. An image formation method according to claim 1, wherein the color image is formed on the basis of an on-drum color superposition system that forms monochromatic toner images of yellow, magenta, cyan and black on one photosensitive drum, and then transfers them.

5. An image formation method according to claim 1, wherein the color image is formed on the basis of a tandem system that forms monochromatic color toner images in mutually independent developing processes and then superposes the resulting monochromatic color toner images to form a multi-color toner image.

6. An image formation method according to claim 5, wherein monochromatic toner images of yellow, magenta, cyan and black are formed by a series of following steps:

(1) a charging step for imparting photosensitivity to an image support (electrostatic recording medium);

(2) an exposure step (latent image formation step) for forming an electrostatic latent image by applying image-forming exposure to said image support, and recording said electrostatic latent image;

(3) a development step for causing a developer (toner) to be attracted electrically to said electrostatic latent image recorded on said image support, and visualizing physically said electrostatic latent image;

(4) an image transfer step for serially transferring said visualized toner images on said image support to a recording medium such as a recording sheet and superposing them; and (5) an image fixation step for heating and fixing said transferred image on said recording medium.

7. An image formation method for forming a color image by using a contact type nonmagnetic one-component developing device in accordance with an electrophotographic process, characterized in that, inside said developing device, a flat sheet-like blade made of a metal flexible member and having a distal end thereof chamfered is used as a toner layer thickness-limiting blade, and a toner having a glass transition point of 55 to 70° C., a weight average particle diameter of 6.0 to 10.0 μm, and containing up to 20 number % of particles having particle diameters of 5 μm or below, is used as a developer, wherein the surface coarseness of said chamfered portion of said toner layer thickness-limiting blade is not greater than 3 μm when the thickness of said blade is 1 μm.

8. An image formation method according to claim 7, wherein said chamfered portion of said toner layer thickness-limiting blade satisfies the following relation when the chamfer distance of said blade in the thickness-wise direction is h1 and the chamfer distance of said blade in the width-wise direction is h2:

$$1 \leq h2/h1 \leq 5.$$

9. An image formation apparatus for forming a color image, including a contact type nonmagnetic one-component developing device, characterized in that said developing device has a flat sheet-like blade made of a metal flexible member and having a distal end portion thereof chamfered, as a toner layer thickness-limiting blade for limiting a developer layer thickness on a developing roller provided thereto, and a toner having a glass transition point of 55 to 70° C. and a weight average particle diameter of 6.0 to 10.0 μm, and containing up to 20 number % of particles having particle diameters of 5 μm or below is used as said developer stored in said developing device.

10. An image formation apparatus according to claim 9, wherein said chamfered portion of said toner layer thickness-limiting blade is further polished.

11. An image formation apparatus according to claim 9, wherein said toner layer thickness-limiting blade is made of a flat sheet-like stainless steel for springs.

12. An image formation apparatus according to claim 9, wherein the color image is formed in accordance with an on-drum color superposition system that forms individually monochromatic toner images of yellow, magenta, cyan and black on one photosensitive drum, and then transfers them.

13. An image formation apparatus according to claim 9, wherein the color image is formed in accordance with a tandem system that forms monochromatic color toner images in mutually independent development steps, and then superposes the resulting monochromatic toner images to form a multi-color color toner image.

14. An image formation apparatus for forming a color image, including a contact type nonmagnetic one-component developing device, characterized in that said developing device has a flat sheet-like blade made of a metal flexible member and having a distal end portion thereof chamfered, as a toner layer thickness-limiting blade for limiting a developer layer thickness on a developing roller provided thereto, and a toner having a glass transition point of 55 to 70° C. and a weight average particle diameter of 6.0 to 10.0 μm, and containing up to 20 number % of particles having particle diameters of 5 μm or below is used as said developer stored in said developing device, wherein the surface coarseness of said chamfered portion of said toner layer thickness-limiting blade is not greater than 3 μm when the thickness of said blade is 1 mm.

15. An image formation apparatus according to claim 14, wherein said chamfered portion of said toner layer thickness-limiting blade satisfies the following relation when the chamfer distance of said blade in the thickness-wise direction is h1 and the chamfer distance of said blade in the width-wise direction is h2:

$$1 \leqq h2/h1 \leqq 5.$$

16. An image formation apparatus for forming a color image by visualizing an electrostatic latent image by a developer, including a developing device including:

a developer container for storing a one-component developer;

an image support for forming and holding an electrostatic latent image;

a developer support for transferring said developer to a developing region on said image support, so disposed as to oppose said image support while keeping contact with said image support;

a developer feeding member for supplying said developer inside said developer container to said developer support, so disposed as to be capable of moving while keeping flexible contact with said developer support; and a thickness-limiting member for limiting the thickness of said developer on said developer support, supplied from said developer feeding member; wherein:

said developer support is a rotary member having an outer diameter Dd and its surface linear velocity is Vd;

said developer feeding member is a rotary member having an outer diameter Dr and its surface linear velocity is Vr; and said outer diameters Dd, Dr and said surf ace linear velocities Vd, Vr satisfy the relation $Dd \geqq Dr$, and $Vd = Vr$; and said one-component developer comprises particles having a volume average particle diameter of 6 to 10 μm, the proportion of particles having a volume average particle diameter of 5 μm or below is 0 to 20 number %, and the proportion of particles having a volume average particle diameter of 12.7 μm or above is 0 to 2 vol %.

17. An image formation apparatus according to claim 16, wherein the charge amount of said one-component developer is within the range of −40 to −60 μC/g on said developer support.

18. An image formation apparatus according to claim 17, wherein the charge amount of said one-component developer is within the range of −30 to −50 μC/g within a predetermined period of time ($Dr \times \pi / Vr$).

19. An image formation apparatus according to claim 16, wherein the melt viscosity of said one-component developer is not greater than 50,000 Pasec at 100° C.

20. An image formation apparatus for forming an image by visualizing an electrostatic latent image by using a developer, including a developing device including:

a developer container for storing a one-component developer;

an image support for forming and holding an electrostatic latent image;

a developer support for transferring said developer to a developing region on said image support, so disposed as to oppose said image support while keeping contact with said image support;

a developer feeding member, having an outer diameter Dr and a surface linear velocity of Vr, for supplying said developer inside said developer container to said developer support, so disposed as to be capable of moving while keeping flexible contact with said developer support; and a thickness-limiting member for limiting the thickness of said developer on said developer support, supplied from said developer feeding member; wherein:

said developer support is made of an electrically conductive material and its electric resistance Rd is $1 \times 10^3$ to $1 \times 10^8$ Ω; and said developer feeding member is made of an electrically conductive material, and its electric resistance Rr satisfies the relation $$-4 \leqq \log(Rd/Rr) \leqq 4 (\log(Rd/Rr) \neq 0).$$

21. An image formation apparatus according to claim 20, wherein the charge amount of said one-component developer is within the range of −40 to −60 μC/g on said developer support.

22. An image formation apparatus according to claim 21, wherein the charge amount of said one-component developer is within the range of −30 to −50 μC/g within a predetermined period of time ($Dr \times \pi / Vr$).

23. An image formation method for forming a color image by using a contact type nonmagnetic one-component developing device in accordance with an electrophotographic process, characterized in that, inside said developing device, a flat sheet-like blade made of a metal flexible member and having a distal end thereof chamfered is used as a toner layer thickness-limiting blade, and a toner having a glass transition point of 55 to 70° C., a weight average particle diameter of 6.0 to 10.0 μm, and containing up to 20 number % of particles having particle diameters of 5 μm or below, is used as a developer, wherein said chamfered portion of said toner layer thickness-limiting blade satisfies the following relation when the chamfer distance of said blade in the thickness-wise direction is h1 and the chamfer distance of said blade in the width-wise direction is h2:

$$1 \leqq h2/h1 \leqq 5.$$

24. An image formation apparatus for forming a color image, including a contact type nonmagnetic one-component developing device, characterized in that said developing device has a flat sheet-like blade made of a metal flexible member and having a distal end portion thereof chamfered, as a toner layer thickness-limiting blade for limiting a developer layer thickness on a developing roller provided thereto, and a toner having a glass transition point of 55 to 70° C. and a weight average particle diameter of 6.0 to 10.0 μm, and containing up to 20 number % of particles having particle diameters of 5 μm or below is used as said developer stored in said developing device, wherein said chamfered portion to said toner layer thickness-limiting blade satisfies the following relation when the chamfer distance of said blade in the thickness-wise direction is h1 and the chamfer distance of said blade in the width-wise direction is h2:

$$1 \leqq h2/h1 \leqq 5.$$

* * * * *

UNITED STATES PATENT AND TRADEMARK OFFICE

CERTIFICATE OF CORRECTION

PATENT NO. : 6,360,068 B1
DATED : March 19, 2002
INVENTOR(S) : Masakazu Kinoshita et al.

It is certified that error appears in the above-identified patent and that said Letters Patent is hereby corrected as shown below:

Title page,
Item [73], please list the second Assignee as follows:

-- Ricoh Company, Ltd., Tokyo (JP) --

Signed and Sealed this

Tenth Day of September, 2002

*Attest:*

*Attesting Officer*

JAMES E. ROGAN
*Director of the United States Patent and Trademark Office*